US012578129B2

(12) United States Patent
Qiu et al.

(10) Patent No.: US 12,578,129 B2
(45) Date of Patent: Mar. 17, 2026

(54) HEAT PUMP SYSTEM

(71) Applicants: York Guangzhou Air Conditioning and Refrigeration Co., Ltd., Quingyuan (CN); Johnson Controls Tyco IP Holdings LLP, Milwaukee, WI (US)

(72) Inventors: Xiening Qiu, Qingyuan (CN); Tianlong Xiao, Qingyuan (CN); Yong Wang, Qingyuan (CN); Bin Yuan, Qingyuan (CN)

(73) Assignees: York Guangzhou Air Conditioning and Refrigeration Co., Ltd., Qingyuan (CN); Tyco Fire & Security GmbH, Neuhausen am Rheinfall (CH)

( * ) Notice: Subject to any disclaimer, the term of this patent is extended or adjusted under 35 U.S.C. 154(b) by 192 days.

(21) Appl. No.: 18/557,891

(22) PCT Filed: Apr. 24, 2022

(86) PCT No.: PCT/CN2022/088780
§ 371 (c)(1),
(2) Date: Oct. 27, 2023

(87) PCT Pub. No.: WO2022/228345
PCT Pub. Date: Nov. 3, 2022

(65) Prior Publication Data

US 2024/0219082 A1 Jul. 4, 2024

(30) Foreign Application Priority Data

Apr. 29, 2021 (CN) ..... 202110475385.7

(51) Int. Cl.
*F25B 30/02* (2006.01)
*F25B 41/20* (2021.01)

(52) U.S. Cl.
CPC ..... *F25B 30/02* (2013.01); *F25B 41/20* (2021.01); *F25B 2313/02731* (2013.01); *F25B 2313/02741* (2013.01)

(58) Field of Classification Search
CPC ..... F25B 30/02; F25B 41/20; F25B 2313/02731; F25B 2313/02741
See application file for complete search history.

(56) References Cited

U.S. PATENT DOCUMENTS 10,837,680 B2 11/2020 Nishiyama et al.
10,845,099 B2 11/2020 Nishiyama et al.
2019/0257554 A1* 8/2019 Ito ..... F25B 41/39

FOREIGN PATENT DOCUMENTS

CN 101089520 A 12/2007
CN 101487639 A 7/2009
(Continued)

OTHER PUBLICATIONS

Yinglin et al., Air Source Falling Film Water Chiller-Heater Unit, Jan. 2, 2013, CN102853575A, Whole Document (Year: 2013).*
(Continued)

*Primary Examiner* — Larry L Furdge
(74) *Attorney, Agent, or Firm* — Fletcher Yoder, P.C.

(57) ABSTRACT

A heat pump system includes a compressor, a first heat exchanger, a second heat exchanger, and a valve device. The valve device includes a first connecting port connected to an exhaust port of the compressor, a second connecting port connected to a first port of the second heat exchanger, a third connecting port connected to an air suction port of the compressor, a fourth connecting port connected to a first port of the first heat exchanger, and a fifth connecting port connected to a fourth port of the first heat exchanger. In a refrigeration mode, the valve device fluidly couples the third connecting port to the air suction port, and the first heat exchanger operates as a falling film evaporator. In a heating
(Continued)

mode, the valve device fluidly couples the first connecting port to the exhaust port, and the first heat exchanger operates as a condenser.

10 Claims, 33 Drawing Sheets

(56) References Cited

FOREIGN PATENT DOCUMENTS

| | | | | |
|---|---|---|---|---|
| CN | 101769396 | A | | 7/2010 |
| CN | 201757537 | U | | 3/2011 |
| CN | 102583608 | A | | 7/2012 |
| CN | 102853575 | A | * | 1/2013 |
| CN | 102878724 | A | | 1/2013 |
| CN | 103727707 | A | | 4/2014 |
| CN | 104406329 | A | | 3/2015 |
| CN | 104713265 | A | | 6/2015 |
| CN | 105466080 | A | | 4/2016 |
| CN | 107883552 | A | | 4/2018 |
| CN | 107965941 | A | | 4/2018 |
| CN | 108036658 | A | | 5/2018 |

OTHER PUBLICATIONS

European Extended Search Report for EP Application No. 22794815.5, dated Mar. 10, 2025, 7 pages.
PCT International Search Report for PCT Application No. PCT/CN2022/088780, mailed Jul. 25, 2022, 4 pgs.

* cited by examiner

HEAT PUMP SYSTEM

CROSS-REFERENCE TO RELATED APPLICATIONS

This application is a U.S. National Stage Application of International Patent Application No. PCT/CN2022/088780, entitled "HEAT PUMP SYSTEM," filed Apr. 24, 2022, which claims priority from and the benefit of Chinese Patent Application No. 202110475385.7, filed Apr. 29, 2021, each of which is hereby incorporated by reference in its entirety for all purposes.

TECHNICAL FIELD

The present application relates to the field of air conditioning, and in particular to a heat pump system.

BACKGROUND ART

The heat pump system comprises a compressor, two heat exchangers, a throttling device, and a four-way valve, which can meet the requirement for providing air-conditioning cooling capacity to the outside world and providing air-conditioning heating capacity to the outside world. In the prior art, when a water-side heat exchanger of an air-cooled heat pump product can act as a falling film evaporator for use, the water-side heat exchanger cannot act as a condenser for use or its condensing heat exchange effect is poor.

Therefore, there is a need for a heat exchanger that can act as both the falling film evaporator and the condenser for use, and there is a need for a heat pump system using the heat exchanger.

SUMMARY OF THE INVENTION

In order to achieve the above object, the present application provides a heat pump system, and the heat pump system has a refrigeration mode and a heating mode, and comprises a compressor, a first heat exchanger, a second heat exchanger, and a valve device. The compressor comprises an air suction port and an exhaust port. The first heat exchanger is configured to be able to act as a falling film evaporator or a condenser, and the first heat exchanger comprises a first port of the first heat exchanger, a second port of the first heat exchanger, a third port of the first heat exchanger, and a fourth port of the first heat exchanger. The second heat exchanger comprises a first port of the second heat exchanger and a second port of the second heat exchanger. The valve device comprises a first connecting port of the valve device, a second connecting port of the valve device, a third connecting port of the valve device, a fourth connecting port of the valve device, and a fifth connecting port of the valve device. Wherein the first connecting port of the valve device is connected to the exhaust port of the compressor through a pipeline, the second connecting port of the valve device is connected to the first port of the second heat exchanger through a pipeline, the third connecting port of the valve device is connected to the air suction port of the compressor through a pipeline, the fourth connecting port of the valve device is connected to the first port of the first heat exchanger through a pipeline, and the fifth connecting port of the valve device is connected to the fourth port of the first heat exchanger through a pipeline. The valve device is configured to: when the heat pump system is operating in the refrigeration mode, the valve device communicates the third connecting port of the valve device with the air suction port of the compressor, so that the first heat exchanger acts as the falling film evaporator; and when the heat pump system is operating in the heating mode, the valve device communicates the first connecting port of the valve device with the exhaust port of the compressor, so that the first heat exchanger acts as the condenser.

According to the above heat pump system, the valve device comprises at least one valve, and each of the at least one valve is a reversing valve.

According to the above heat pump system, the valve device does not comprise an on-off valve and a one-way valve.

According to the above heat pump system, the valve device comprises a four-way valve and a three-way valve. Wherein the four-way valve comprises four ports, three of the four ports form the first connecting port of the valve device, the second connecting port of the valve device, and the third connecting port of the valve device, respectively, the three-way valve comprises three ports, two of the three ports form the fourth connecting port of the valve device and the fifth connecting port of the valve device, respectively, and a fourth port of the four-way valve is connected to a third port of the three-way valve. Wherein the four-way valve comprises a first pair of circulation channels of the four-way valve and a second pair of circulation channels of the four-way valve, the first pair of circulation channels of the four-way valve can enable the first connecting port of the valve device to be in fluid communication with the second connecting port of the valve device, and can enable the third connecting port of the valve device to be in fluid communication with the fourth connecting port of the four-way valve, and the second pair of circulation channels of the four-way valve can enable the first connecting port of the valve device to be in fluid communication with the fourth port of the four-way valve, and can enable the second connecting port of the valve device to be in fluid communication with the third connecting port of the valve device. Wherein the three-way valve comprises a first circulation channel of the three-way valve and a second circulation channel of the three-way valve, the third port of the three-way valve can be in fluid communication with the fourth connecting port of the valve device through the first circulation channel of the three-way valve, and the third port of the three-way valve can be in fluid communication with the fifth connecting port of the valve device through the second circulation channel of the three-way valve.

According to the above heat pump system, the valve device comprises a five-way valve, the five-way valve comprises five ports, and the five ports form the first connecting port of the valve device, the second connecting port of the valve device, the third connecting port of the valve device, the fourth connecting port of the valve device, and the fifth connecting port of the valve device, respectively.

According to the above heat pump system, the five-way valve comprises a first circulation channel of the five-way valve and a second circulation channel of the five-way valve. The five-way valve has a first state and a second state, and the five-way valve is configured to: when the five-way valve is in the first state, the first connecting port of the valve device communicates with the second connecting port of the valve device, and the third connecting port of the valve device communicates with the fifth connecting port of the valve device; and when the five-way valve is in the second state, the first connecting port of the valve device communicates with the fourth connecting port of the valve device, and the second connecting port of the valve device communicates with the third connecting port of the valve device.

According to the above heat pump system, the five-way valve has a third state, and the five-way valve is configured to: when the five-way valve is in the third state, the first connecting port of the valve device communicates with the third connecting port of the valve device, and the fourth connecting port of the valve device communicates with the fifth connecting port of the valve device.

According to the above heat pump system, the heat pump system further comprises a communication pipe, and the communication pipe is configured to controllably communicate the exhaust port of the compressor with the second port of the second heat exchanger. The five-way valve has a fourth state, and the five-way valve is configured to: when the five-way valve is in the fourth state, the third connecting port of the valve device communicates with the fourth connecting port of the valve device, and the second connecting port of the valve device communicates with the fifth connecting port of the valve device.

According to the above heat pump system, a flash tank is disposed in the first heat exchanger.

According to the above heat pump system, the heat pump system comprises a flash tank or an economizer.

The heat pump system of the present application can reduce a pressure drop of a system, and especially a pressure drop from the exhaust port of the compressor to an inlet of the first heat exchanger and a pressure drop from an outlet of the first heat exchanger to the air suction port of the compressor are reduced.

Other features, advantages and embodiments of the present application may be set forth or become apparent by consideration of the following detailed description, accompanying drawings and claims. In addition, it should be understood that the above summaries of the invention and the following specific embodiments are all exemplary and intended to provide further explanations rather than limit the scope of the present application to be claimed. However, the detailed description and specific examples indicate only preferred embodiments of the present application. Various changes and modifications within the spirit and scope of the present application will become apparent to those skilled in the art from this detailed description.

BRIEF DESCRIPTION OF THE DRAWINGS

The features and advantages of the present application may be better understood by reading the following detailed description with reference to the accompanying drawings; and in the whole accompanying drawings, like reference numerals refer to like components throughout.

DETAILED DESCRIPTION OF EMBODIMENTS

Figure 1:
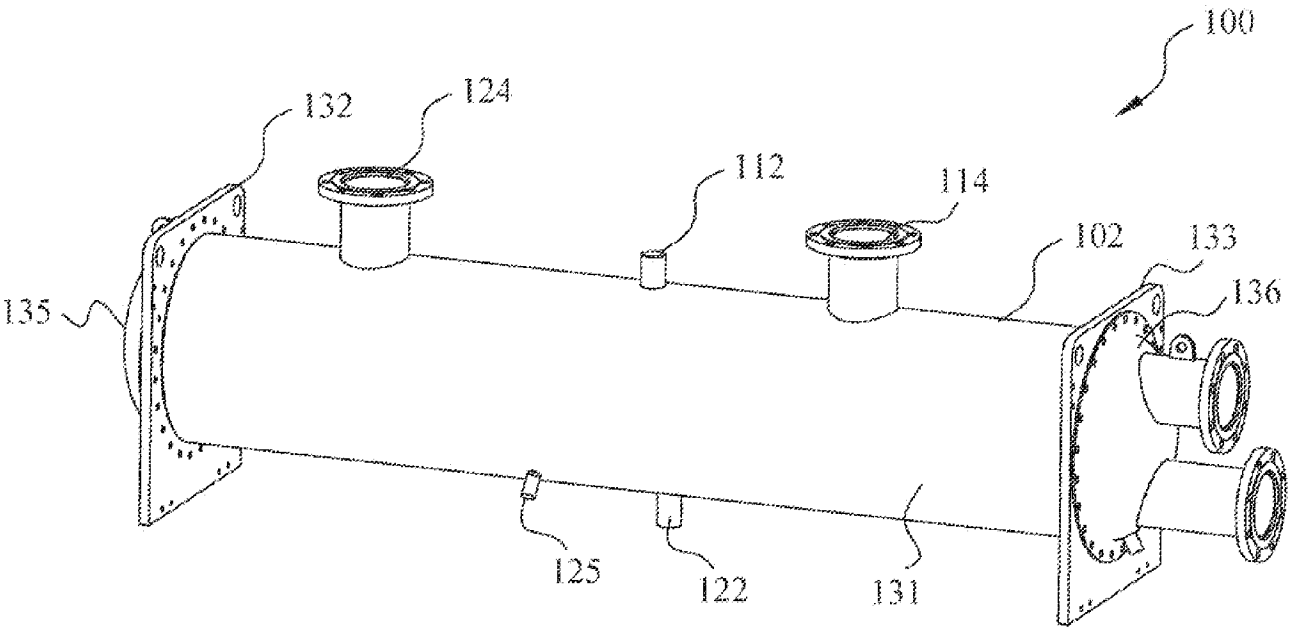
FIG. 1 is a perspective view of a heat exchanger of the present application.

Various specific implementations of the present invention will be described below with reference to the accompanying drawings, which constitute a part of the Specification. It should be understood that although terms, such as "upper", "lower", "left", "right", etc., that represent directions are used in the present invention to directionally or orientationally describe various example structural parts and elements of the present invention, these terms used herein are determined based on example orientations shown in the accompanying drawings for case of illustration only. Since the embodiments disclosed in the present invention may be disposed in different directions, these terms that represent directions are for illustration only and should not be regarded as limiting. In the following accompanying drawings, same parts use same reference numerals.

It should be understood that ordinal numbers, such as "first" and "second" used in the present application are only for distinction and identification, and do not have any other meaning. Unless otherwise specified, they do not indicate a specific order, nor do they have a specific relevance. For example, the term "first heat exchanger" by itself does not imply the presence of a "second heat exchanger", nor does the term "second heat exchanger" by itself imply the presence of a "first heat exchanger".

Figure 2:
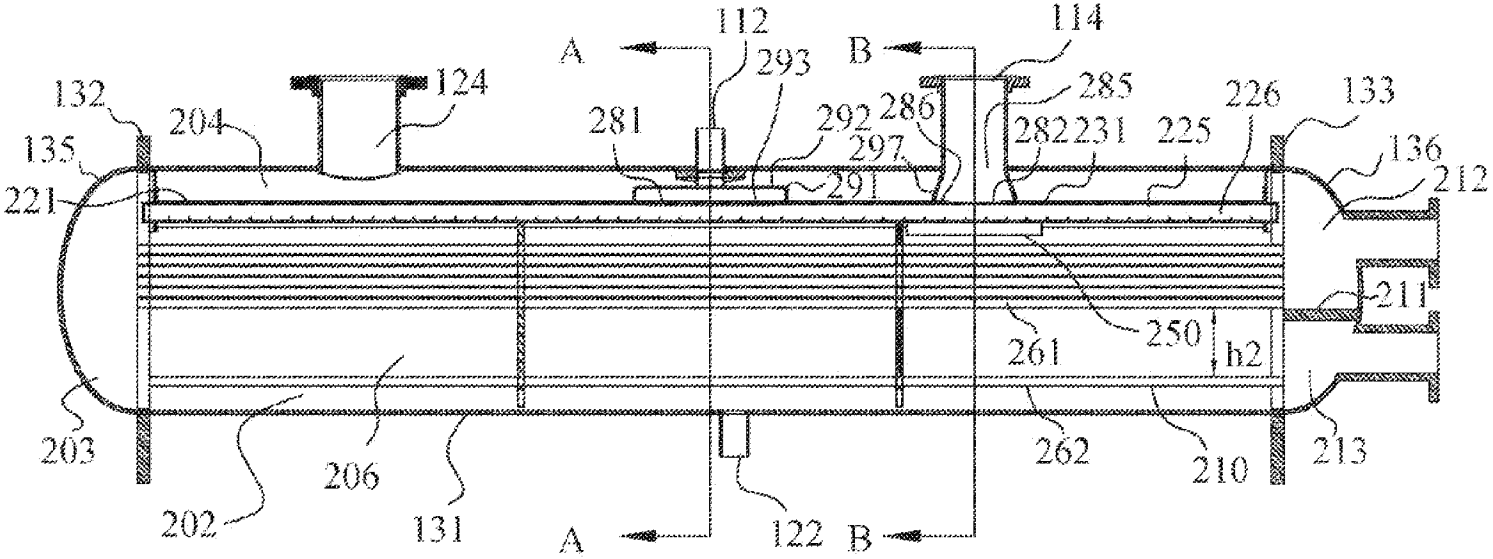
FIG. 2 is an axial cross-sectional view of the heat exchanger shown in FIG. 1.
Figure 3:
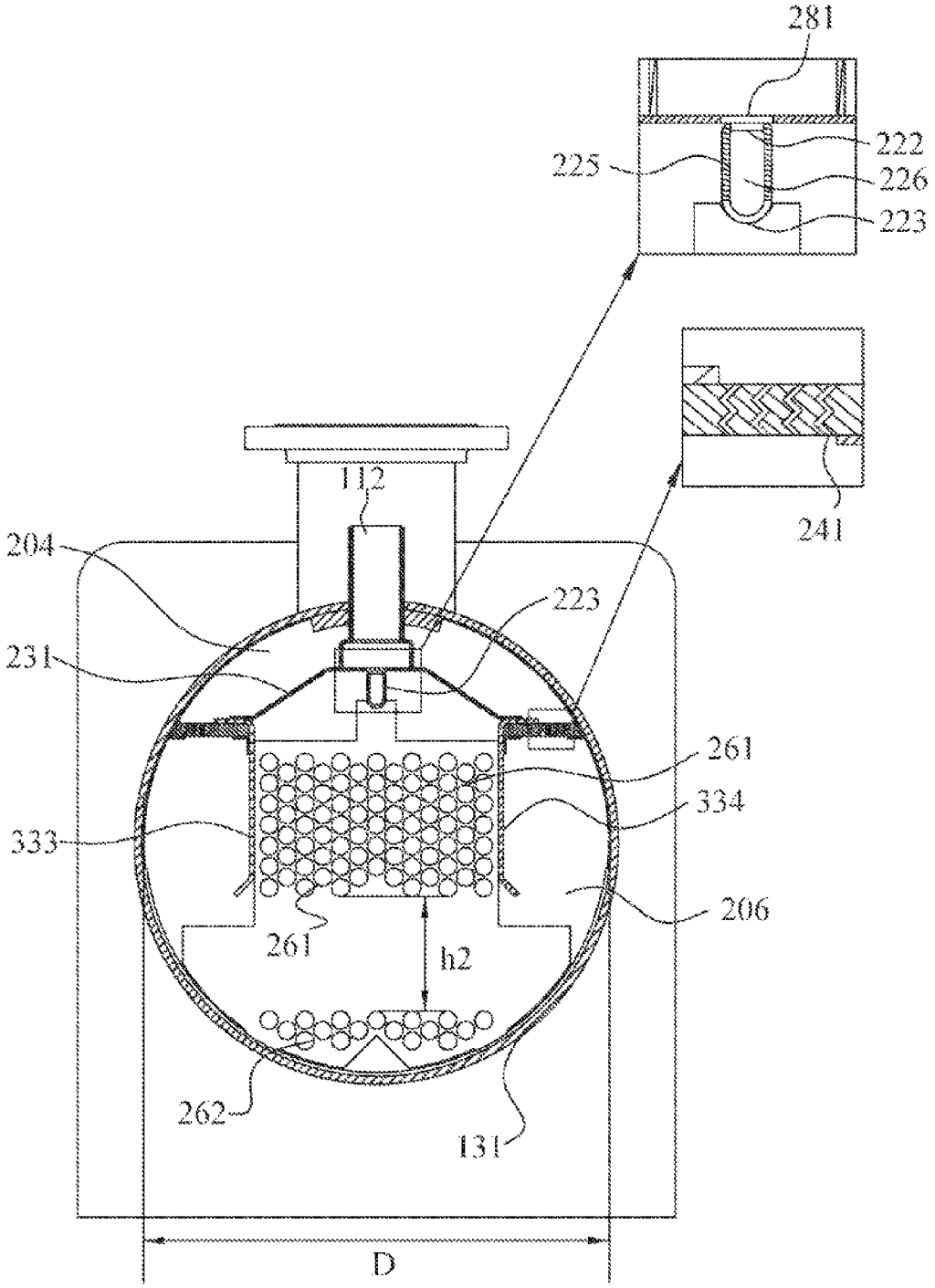
FIG. 3 is a cross-sectional view of the heat exchanger shown in FIG. 1 along a line A-A in FIG. 2.
Figure 4:
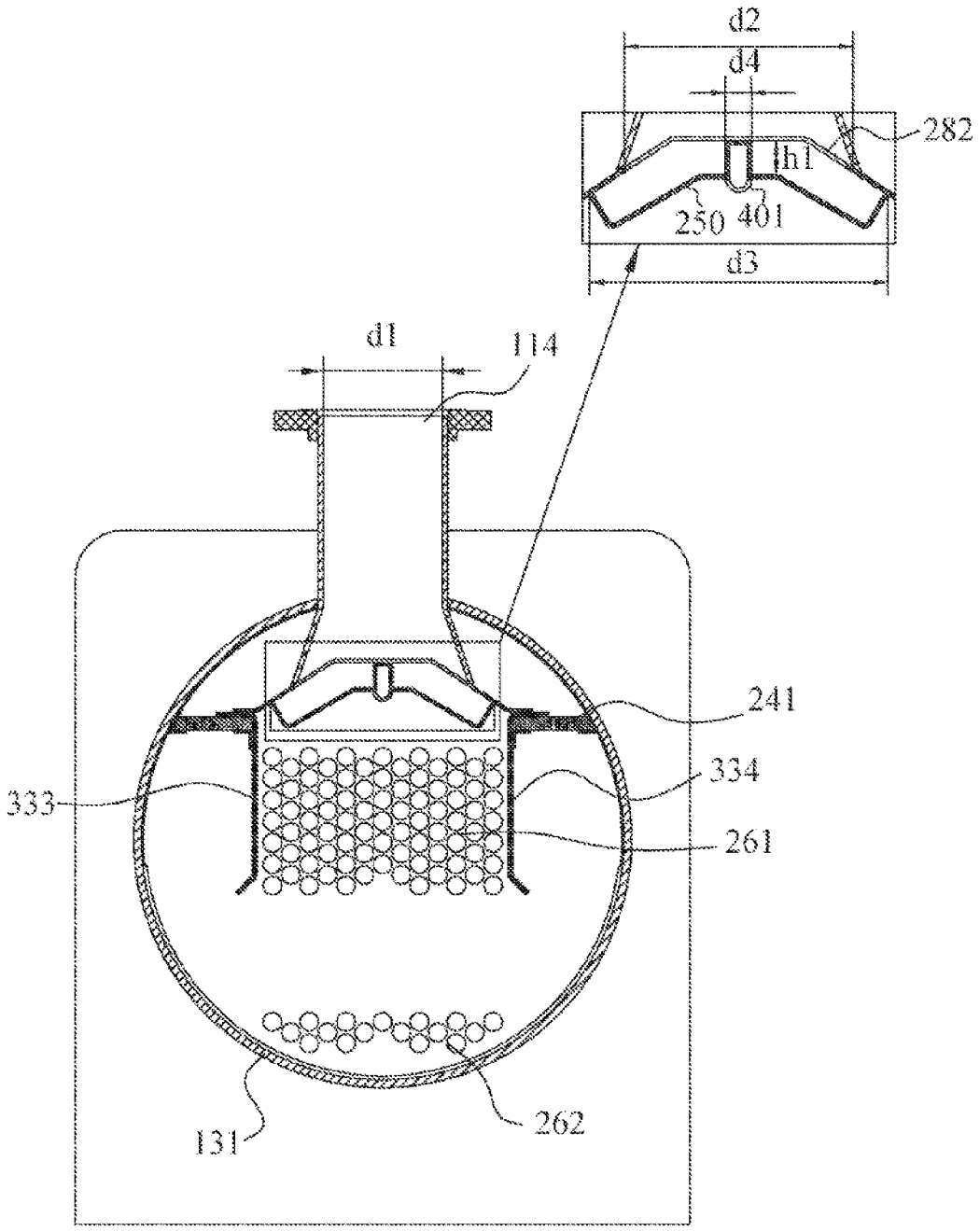
FIG. 4 is a cross-sectional view of the heat exchanger shown in FIG. 1 along a line B-B in FIG. 2.

FIG. 1 is a perspective view of a heat exchanger 100 of the present application, FIG. 2 is an axial cross-sectional view of the heat exchanger 100 shown in FIG. 1, FIG. 3 is a cross-sectional view of the heat exchanger 100 shown in FIG. 1 along a line A-A in FIG. 2, and FIG. 4 is a cross-sectional view of the heat exchanger 100 shown in FIG. 1 along a line B-B in FIG. 2, so as to show a specific structure of the heat exchanger 100.

As shown in FIGS. 1-4, the heat exchanger 100 comprises a housing 102. The housing 102 comprises a cylinder 131, a left partition plate 132, a right partition plate 133, a left end plate 135, and a right end plate 136. Wherein the cylinder 131 has an inner diameter D. The cylinder 131 is formed by extending along a length direction of the heat exchanger 100. The left and right ends of the cylinder 131 are closed by the left partition plate 132 and the right partition plate 133 respectively to form a containing cavity 202. The left end plate 135 is arc-shaped, and the left end plate 135 is connected to the left partition plate 132 to form a communication cavity 203. The right end plate 136 is also arc-shaped, and the right end plate 136 is connected to the right partition plate 133. The right partition plate 133 further comprises a transverse partition plate 211 extending laterally from the right partition plate 133 to the right end plate 136, thereby forming an outlet containing cavity 212 and an inlet containing cavity 213.

As shown in FIGS. 1-2, the heat exchanger 100 further comprises a first inlet pipe 112, a second inlet pipe 114, a first outlet pipe 124, a second outlet pipe 122, and an oil return pipe 125. The first inlet pipe 112, the second inlet pipe 114, the first outlet pipe 124, the second outlet pipe 122 and the oil return pipe 125 are connected to the housing 102, and are in refrigerant communication with the containing cavity 202. The first inlet pipe 112, the second inlet pipe 114 and the first outlet pipe 124 are approximately located at an upper part of the cylinder 131. Wherein the first outlet pipe 124, the first inlet pipe 112 and the second inlet pipe 114 are arranged along a length direction of the housing 102. The first outlet pipe 124 is located at a left part of the housing 102, the first inlet pipe 112 is located at a middle part of the housing 102, and the second inlet pipe 114 is located at a right part of the housing 102. The second outlet pipe 122 and the oil return pipe 125 are approximately located at a lower part of the cylinder 131. Wherein the second outlet pipe 122 is located at the bottom of the housing 102, and in the length direction of the housing 102, the second outlet pipe 122 is located at the middle part of the housing 102. The oil return pipe 125 is located at the lower part of the housing 102, in the length direction of the housing 102, the oil return pipe 125 is located at the left part of the housing 102, and in a radial direction of the housing 102, the oil return pipe is disposed downward in a manner of tilting in a vertical direction.

The heat exchanger 100 of the present application has an evaporator operating mode and a condenser operating mode. When the heat exchanger 100 is in the evaporator operating mode or the condenser operating mode, refrigerants will have different flow paths after entering the heat exchanger 100 from different inlets. As shown in FIGS. 1-2, the heat exchanger 100 further comprises a refrigerant guiding structure. The refrigerant guiding structure is disposed in the containing cavity 202 to define the different flow paths for the heat exchanger 100 in the evaporator operating mode and in the condenser operating mode. Specifically, the refrigerant guiding structure comprises a main baffle assembly 231. The main baffle assembly 231 is formed by extending along the length direction of the housing 102 and is transversely placed in the containing cavity 202 to divide the containing cavity 202 into a first containing cavity 204 located at an upper part and a second containing cavity 206 located at a lower part. As shown in FIGS. 3-4, on a radial cross-section of the housing 102, the main baffle assembly 231 is approximately in a stepped shape with lower both ends and a higher middle. Lower portions of both ends of the main baffle assembly 231 are provided with a plurality of channels 241, so that the first containing cavity 204 at the upper part can communicate with the second containing cavity 206 located at the lower part through the plurality of channels 241. Specifically, the channels 241 are in a broken line shape. Each channel 241 has four adjacent broken line segments, and two adjacent broken line segments are approximately 90°, so that the refrigerants can change movement directions multiple times when moving in the channels 241. The higher portion in the middle of the main baffle assembly 231 is provided with a first communication port 281 and a second communication port 282. In the length direction of the housing 102, the first communication port 281 is approximately located at a middle position, and the second communication port 282 is approximately arranged near a right end. The first inlet pipe 112 communicates with the first communication port 281, and an outlet of the second inlet pipe 114 communicates with the second communication port 282.

It should be noted that although the above channels 241 are shown as the broken line shape, other structures such as wire meshes may also be used as the channels, as long as the lower portions of both ends of the main baffle assembly 231 can communicate the first containing cavity 204 at the upper part with the second containing cavity 206 located at the lower part through a plurality of channels 241.

As shown in FIG. 2, the refrigerant guiding structure of the heat exchanger 100 further comprises a first inlet pipe expander 291. The first inlet pipe expander 291 is disposed in the first containing cavity 204. The first inlet pipe expander is disposed on the first communication port 281 in a covering manner, and is connected to the first inlet pipe 112 and the main baffle assembly 231. Specifically, the first inlet pipe expander 291 is a pipe with a larger pipe diameter than the first inlet pipe 112. An upper part of a second inlet pipe expander 297 is connected to the first inlet pipe 112, and an opening 292 at the upper part of the second inlet pipe expander communicates with an outlet of the first inlet pipe 112. A lower part of the second inlet pipe expander 297 is disposed on the main baffle assembly 231 in a covering manner, so that an opening 293 at the lower part of the second inlet pipe expander communicates with the first communication port 281. Therefore, the refrigerants flowing in from the first inlet pipe 112 can flow into the second containing cavity 206 through the first inlet pipe expander 291 and the first communication port 281. After the refrigerants flow out of the first inlet pipe 112, the flow speed of the refrigerants can be reduced in the first inlet pipe expander 291.

As shown in FIGS. 2-3, the refrigerant guiding structure of the heat exchanger 100 further comprises a distributor 221. The distributor 221 is disposed below the main baffle assembly 231. The distributor 221 comprises a distributor housing 225, which defines a distributor containing cavity 226. The distributor housing 225 is formed by approximately extending along the length direction of the housing 102. An upper part of the distributor housing 225 is provided with a distributor inlet 222. Specifically, the distributor inlet 222 is approximately disposed at the middle part along the length direction of the housing 102, and is disposed below the first communication port 281 on the main baffle assembly 231, so that the refrigerants can flow into the distributor containing cavity 226 through the first communication port 281 and the distributor inlet 222. A lower part of the distributor housing 225 is provided with a plurality of distributor outlets 223. Specifically, the plurality of distributor outlets 223 are arranged at intervals along the length direction of the housing 102, so that the refrigerants flowing in the distributor containing cavity 226 can flow along the length direction of the housing 102 and flow into the second containing cavity 206 through the distributor outlets 223. In the example of the present application, the distributor outlets 223 are in a narrow strip shape. However, those skilled in the art can understand that the distributor outlets 223 may be in any shape.

As shown in FIG. 2, the refrigerant guiding structure of the heat exchanger 100 further comprises the second inlet pipe expander 297. The second inlet pipe expander 297 is disposed in the first containing cavity 204. The second inlet pipe expander is disposed on the second communication port 282 in a covering manner, and is connected to the second inlet pipe 114 and the main baffle assembly 231. Specifically, the second inlet pipe expander 297 is approximately trumpet-shaped. An upper part of the second inlet pipe expander is smaller, while a lower part of the second inlet pipe expander is larger. The upper part of the second inlet pipe expander is connected to the second inlet pipe 114, and the opening 285 at the upper part of the second inlet pipe expander communicates with the outlet of the second inlet pipe 114. The lower part of the second inlet pipe expander is disposed on the main baffle assembly 231 in a covering manner, and the opening 286 at the lower part of the second inlet pipe expander communicates with the second communication port 282. Wherein the opening 285 at the upper part of the second inlet pipe expander 297 has the same size as the outlet of the second inlet pipe 114, and their diameters are both a first diameter d1. A diameter of the opening 286 at the lower part of the second inlet pipe expander 297 is a second diameter d2. The second diameter d2 is greater than the first diameter d1, so that the flow speed of the refrigerants flowing in from the second inlet pipe 114 can be reduced in the second inlet pipe expander 297.

As shown in FIG. 2 and FIG. 4, the refrigerant guiding structure of the heat exchanger 100 further comprises a buffer 250. The buffer 250 is disposed below the main baffle assembly 231, and is disposed below the second communication port 282. In the embodiment of the present application, the buffer 250 is a buffer plate. The buffer plate has a buffer length extending along the length direction of the housing 102, and has a buffer width extending along a width direction of the housing 102. A shape of the buffer plate is similar to that of the main baffle assembly 231. Specifically, on the radial cross-section of the housing 102, the buffer plate is approximately in a stepped shape with lower both ends and a higher middle. In addition, on the radial cross-section of the housing 102, both sides of the buffer plate in the width direction are tilted upward, and are connected to the main baffle assembly 231. The buffer length and the buffer width of the buffer plate are configured to be able to cover the second communication port 282, so that the refrigerants flowing into from the second communication port 282 can flow along a direction of the buffer length of the buffer plate to enter the second containing cavity 206. In one example, a width of the buffer plate is d3. Wherein d3:d2 is greater than or equal to 1:1 and less than or equal to 5:1, so that the buffer plate can cover the second communication port 282. In another example, there is a first distance h1 between the buffer plate and the top of the second communication port 282. In yet another example, a width of the distributor 221 in the width direction of the housing 102 is d4. Wherein d2:d4 is greater than or equal to 2:1 and less than or equal to 5:1, so that the distributor 221 does not excessively block the flow of the refrigerants flowing through the opening 286 at the lower part of the second inlet pipe expander 297.

It should be noted that the buffer plate is also provided with channels 401 arranged along its buffer length to contain a part of the distributor 221. The distributor outlets 223 of the distributor 221 are disposed at a lower part of the buffer plate, so that the refrigerants flowing in from the first inlet pipe 112 can flow into the second containing cavity 206 through the distributor outlets 223 without being affected by the buffer plate.

As shown in FIGS. 3-4, the refrigerant guiding structure of the heat exchanger 100 further comprises a first additional plate 333 and a second additional plate 334. The first additional plate 333 and the second additional plate 334 are respectively connected to the main baffle assembly 231. Specifically, the first additional plate 333 and the second additional plate 334 are formed by extending along the length direction of the housing 102, and are approximately vertically disposed in the second containing cavity 206. The first additional plate 333 and the second additional plate 334 are respectively connected to the lower portions of the main baffle assembly 231 in the stepped shape, and formed by approximately extending downward.

As shown in FIGS. 2-4, the heat exchanger 100 further comprises a heat exchange pipe bundle 210. The heat exchange pipe bundle 210 is disposed in the second containing cavity 206, and is located below the first inlet pipe 112, the second inlet pipe 114 and the first outlet pipe 124 and above the second outlet pipe 122. Specifically, the heat exchange pipe bundle 210 comprises a first group of heat exchange pipes 261 and a second group of heat exchange pipes 262. The first group of heat exchange pipes 261 comprise a first number of heat exchange pipes, the second group of heat exchange pipes 262 comprise a second number of heat exchange pipes, and a ratio of the first number to the second number is greater than 2:1. The first group of heat exchange pipes 261 are approximately arranged at a middle part of the second containing cavity 206, and are formed by extending along the length direction of the housing 102. The left ends of the heat exchange pipes in the first group of heat exchange pipes 261 communicate with the communication cavity 203 on a left side of the heat exchanger 100, and the right ends of the heat exchange pipes in the first group of heat exchange pipes 261 communicate with the outlet containing cavity 212 on a right side of the heat exchanger 100. The second group of heat exchange pipes 262 are approximately arranged at a lower part of the second containing cavity 206, and are formed by extending along the length direction of the housing 102. The left ends of the heat exchange pipes in the second group of heat exchange pipes 262 communicate with the communication cavity 203 on the left side of the heat exchanger 100, and the right ends of the second group of heat exchange pipes 262 communicate with the inlet containing cavity 213 on the right side of the heat exchanger 100. In this way, heat exchange refrigerants may enter the heat exchanger 100 from the inlet containing cavity 213 on the right side of the heat exchanger 100, flow through the second group of heat exchange pipes 262, the communication cavity 203 and the first group of heat exchange pipes 261 in sequence, and then flow out of the heat exchanger 100 from the outlet containing cavity 212. When the heat exchange refrigerants flow in the first group of heat exchange pipes 261 and the second group of heat exchange pipes 262, the heat exchange refrigerants can exchange heat with the refrigerants in the second containing cavity 206. In addition, the inner diameter of the cylinder 131 is D. There is a second distance h2 between the bottoms of the first group of heat exchange pipes 261 and the tops of the second group of heat exchange pipes 262. That is to say, a distance between the bottoms of the lowermost layer of heat exchange pipes of the first group of heat exchange pipes 261 and the tops of the uppermost layer of heat exchange pipes of the second group of heat exchange pipes 262 is the second distance h2. Wherein a ratio of the second distance h2 to the inner diameter D is less than 1:2.

Therefore, the refrigerant guiding structure is configured to define the different flow paths of the heat exchanger 100 in the condenser operating mode and in the evaporator operating mode, respectively. When the heat exchanger 100 is in the evaporator operating mode, the refrigerant guiding structure guides the refrigerants flowing in from the first inlet pipe 112 to exchange heat with the refrigerants in the heat exchange pipe bundle 210 to evaporate them into gas, and guides the gas formed by evaporation to be discharged out of the heat exchanger 100 via the first outlet pipe 124. When the heat exchanger 100 is in the condenser operating mode, the refrigerant guiding structure guides the refrigerants flowing in from the second inlet pipe 114 to exchange heat with the refrigerants in the heat exchange pipe bundle 210 to condense them into liquid, and then discharges the liquid formed by condensing out of heat exchanger 100 via the second outlet pipe 122. This will be explained in detail later in conjunction with the different operating modes shown in FIGS. 5A-5B and FIGS. 6A-6B.

The heat exchanger 100 shown in FIGS. 1-4 has the evaporator operating mode and the condenser operating mode. When the heat exchanger 100 is in the evaporator operating mode, the heat exchanger 100 acts as an evaporator for use. When the heat exchanger 100 is in the condenser operating mode, the heat exchanger 100 acts as a condenser for use. The flow paths of the refrigerants in the heat exchanger 100 when the heat exchanger 100 is in the evaporator operating mode and the condenser operating mode will be described below in conjunction with FIGS. 5A-5B and FIGS. 6A-6B, respectively.

Figure 5A:
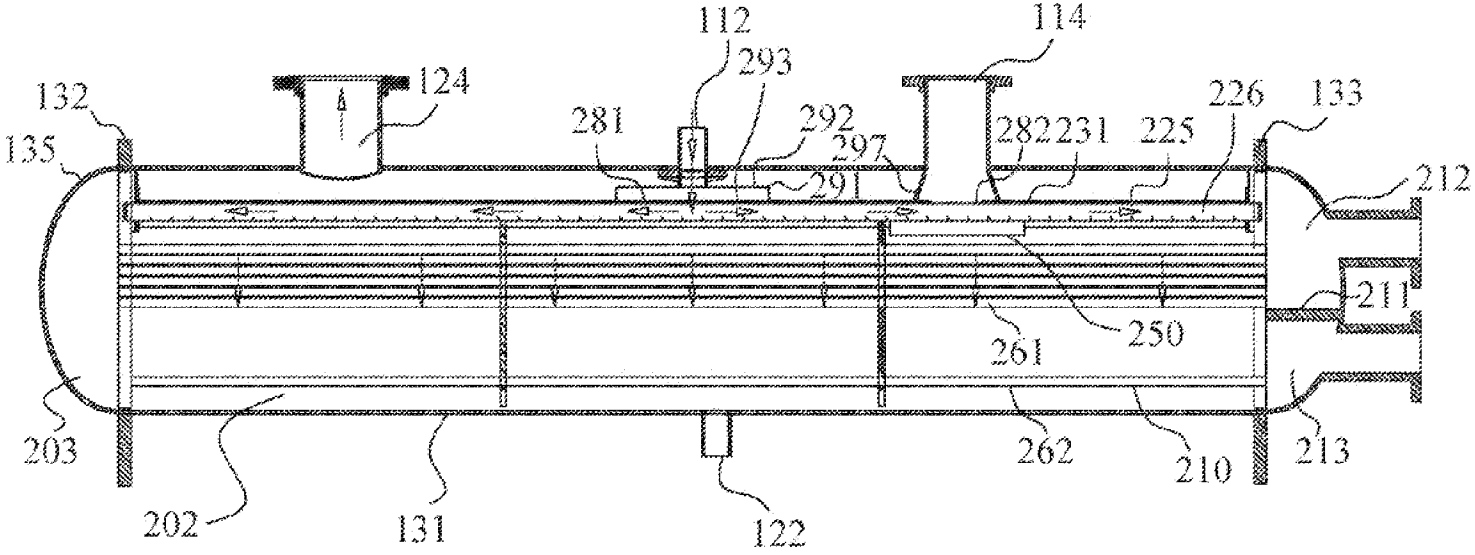
FIG. 5A is an axial cross-sectional view of the heat exchanger shown in FIG. 1, showing a movement trajectory of a refrigerant on the axial cross-sectional view of the heat exchanger when the heat exchanger is in an evaporator operating mode.
Figure 5B:
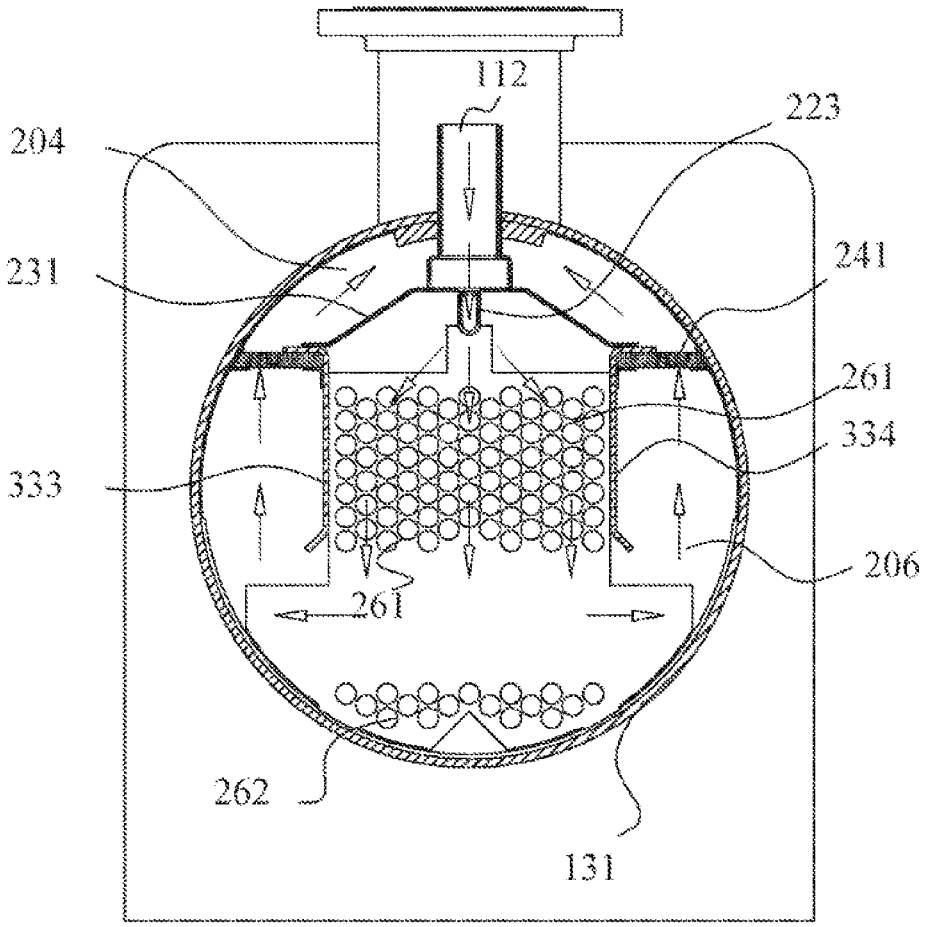
FIG. 5B is a cross-sectional view of the heat exchanger shown in FIG. 1 along the line A-A in FIG. 2, showing a movement trajectory of the refrigerant on a radial cross-sectional view of the heat exchanger when the heat exchanger is in the evaporator operating mode.

FIG. 5A is an axial cross-sectional view of the heat exchanger 100 shown in FIG. 1, showing a movement trajectory of the refrigerants on the axial cross-sectional view of the heat exchanger 100 when the heat exchanger 100 is in the evaporator operating mode. FIG. 5B is a cross-sectional view of the heat exchanger 100 shown in FIG. 1 along a line A-A in FIG. 2, showing a movement trajectory of the refrigerants on a radial cross-sectional view of the heat exchanger 100 when the heat exchanger 100 is in the evaporator operating mode. As shown in FIGS. 5A-5B, when the heat exchanger 100 is in the evaporator operating mode, the refrigerants (e.g., gas-liquid mixtures) flow into the heat exchanger 100 from the first inlet pipe 112. Then, the refrigerants flow through the first inlet pipe expander 291, the first communication port 281 on the main baffle assembly 231 and the distributor inlet 222 in sequence to flow into the distributor containing cavity 226 of the distributor 221. Since the distributor containing cavity 226 extends along the length direction of the housing 102, the refrigerants contained in the distributor containing cavity 226 will also move along the length direction of the housing 102. That is to say, in the length direction of the housing 102, the refrigerants will flow from the middle part to both sides. In the flow process, since the lower part of the distributor 221 is provided with the plurality of distributor outlets 223, the refrigerants will flow downward. It can be seen that since the plurality of distributor outlets 223 are arranged along the length direction of the housing 102, the refrigerants can flow downward relatively uniformly along the length direction of the housing 102 and flow through the first group of heat exchange pipes 261 from top to bottom. The heat exchange refrigerants at a relatively high temperature flow in the first group of heat exchange pipes 261. The refrigerants make contact with the first group of heat exchange pipes 261 and exchange heat with the heat exchange refrigerants in the first group of heat exchange pipes 261. Specifically, in the process that the refrigerants flow downward to make contact with the first group of heat exchange pipes 261, the refrigerants are distributed in the uppermost row of heat exchange pipes, and form a liquid film on the uppermost row of heat exchange pipes for evaporation. The unevaporated liquid refrigerants drip onto the next row of heat exchange pipes to continue to evaporate. The liquid refrigerants may always flow downward and form a liquid film on the first group of heat exchange pipes 261 for evaporation. The refrigerants that do not evaporate on the first group of heat exchange pipes 261 flow downward to make contact with the second group of heat exchange pipes 262, exchange heat with the heat exchange refrigerants in the second group of heat exchange pipes 262, are increased in temperature, and evaporate. Since the first additional plate 333 and the second additional plate 334 are arranged on both sides of the first group of heat exchange pipes 261, the refrigerants that evaporate into gas at the positions of the first group of heat exchange pipes 261 continue to flow downward until they pass over lower edges of the first additional plate 333 and the second additional plate 334, and then the refrigerants that evaporate into gas flow upward. In other words, in the radial direction of the housing 102, the refrigerants that evaporate into gas pass downward over the first group of heat exchange pipes 261, then flow to both sides, and then flow upward. The refrigerants that evaporate into gas will enter the first containing cavity 204 after passing through the plurality of channels 241 on the main baffle assembly 231, and then flow out of the heat exchanger 100 through the first outlet pipe 124. Another part of the refrigerants that evaporate into gas at the positions of the second group of heat exchange pipes 262 flows upward and enters the first containing cavity 204 after passing through the plurality of channels 241 on the main baffle assembly 231, and then flows out of the heat exchanger 100 through the first outlet pipe 124. It should be noted that when the heat exchanger 100 is in the evaporator operating mode, the liquid refrigerants can be deposited at the bottom of the second containing cavity 206 and exchange heat with the second group of heat exchange pipes 262 for evaporation.

Figure 6A:
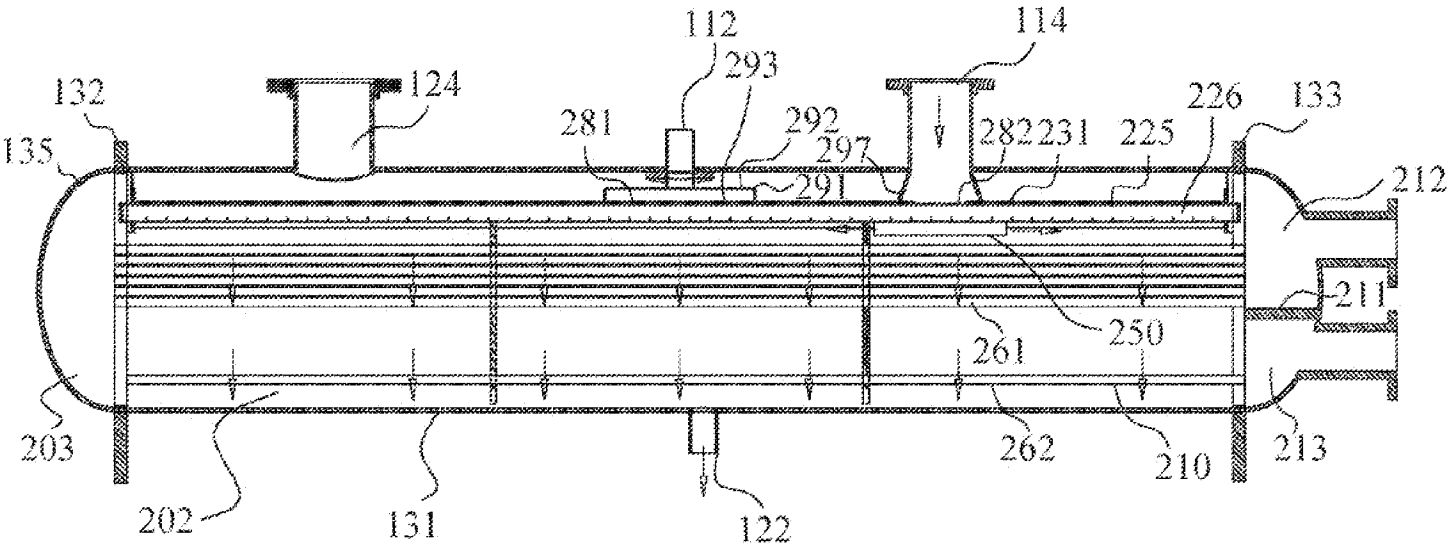
FIG. 6A is an axial cross-sectional view of the heat exchanger shown in FIG. 1, showing a movement trajectory of the refrigerant on the axial cross-sectional view of the heat exchanger when the heat exchanger is in a condenser operating mode.
Figure 6B:
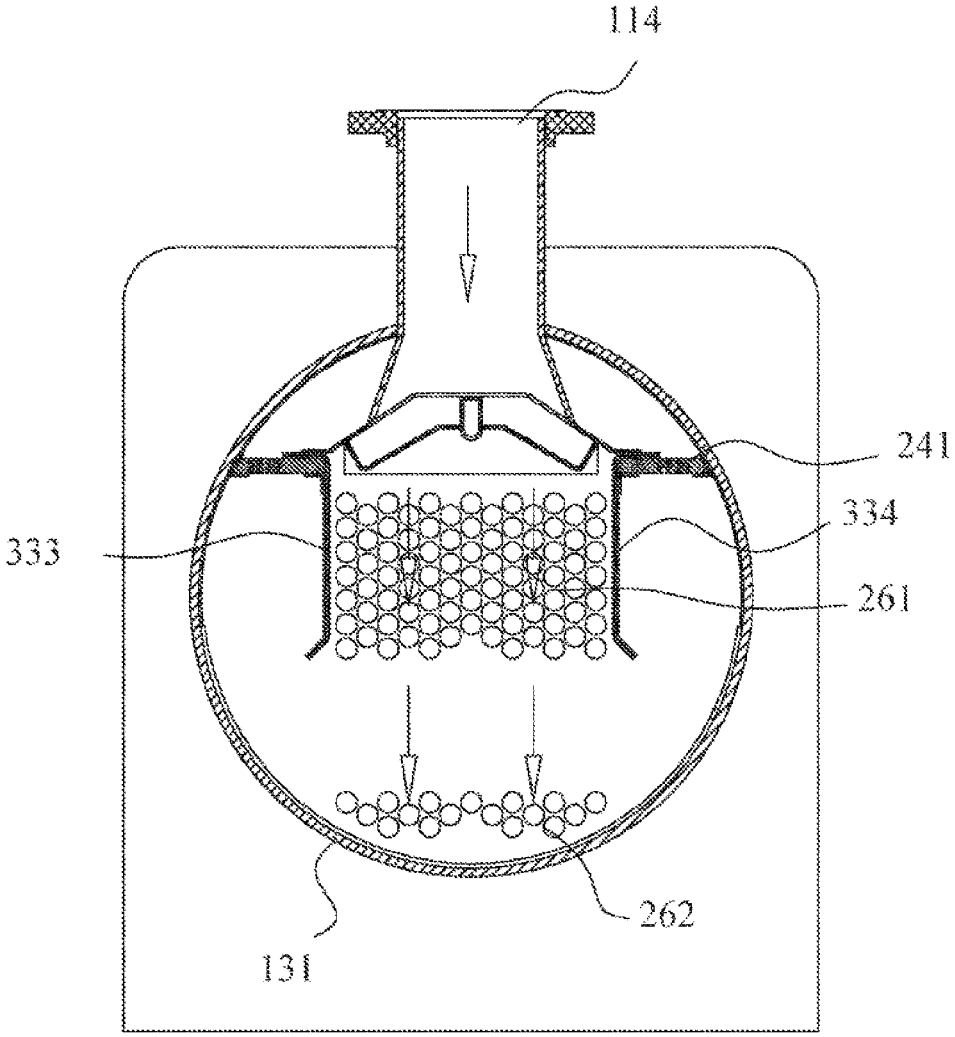
FIG. 6B is a cross-sectional view of the heat exchanger shown in FIG. 1 along the line B-B in FIG. 2, showing a movement trajectory of the refrigerant on the radial cross-sectional view of the heat exchanger when the heat exchanger is in the condenser operating mode.

FIG. 6A is an axial cross-sectional view of the heat exchanger 100 shown in FIG. 1, showing a movement trajectory of the refrigerants on the axial cross-sectional view of the heat exchanger 100 when the heat exchanger 100 is in the condenser operating mode. FIG. 6B is a cross-sectional view of the heat exchanger 100 shown in FIG. 1 along a line B-B in FIG. 2, showing a movement trajectory of the refrigerants on a radial cross-sectional view of the heat exchanger when the heat exchanger 100 is in the condenser operating mode. As shown in FIGS. 6A-6B, when the heat exchanger 100 is in the condenser operating mode, the refrigerants (e.g., gas with a relatively high flow rate) flow into the heat exchanger 100 from the second inlet pipe 114. Then, the refrigerants pass through the second inlet pipe expander 297 and the second communication port 282 on the main baffle assembly 231 in sequence to enter the second containing cavity 206. Since the movement speed of the refrigerants is relatively high, the refrigerants flowing into the second containing cavity 206 will directly impact the buffer 250. Since the width direction of the buffer 250 is connected to the main baffle assembly 231, the refrigerants can move along the length direction of the housing 102 and move downward after passing over the buffer 250. The refrigerants then flow to the first group of heat exchange pipes 261. The heat exchange refrigerants at a relatively low temperature (but a higher temperature compared with that of the second group of heat exchange pipes 262) flow in the first group of heat exchange pipes 261. The refrigerants make contact with the first group of heat exchange pipes 261 and exchange heat with the heat exchange refrigerants in the first group of heat exchange pipes 261. In the process that the refrigerants flow downward to make contact with the first group of heat exchange pipes 261, the refrigerants condense into liquid and are accumulated at the bottom of the second containing cavity 206. When the refrigerants that condense into liquid are accumulated at the bottom of the second containing cavity 206, the refrigerants can enable the second group of heat exchange pipes 262 to be immersed in the liquid. Since the heat exchange refrigerants at a relatively low temperature flow in the second group of heat exchange pipes 262, the refrigerants that condense into liquid will continue to exchange heat with the heat exchange refrigerants in the second group of heat exchange pipes 262, thereby further reducing the temperature. Then, the refrigerants that condense into liquid may flow out of the heat exchanger 100 from the second outlet pipe 122.

Figure 7:
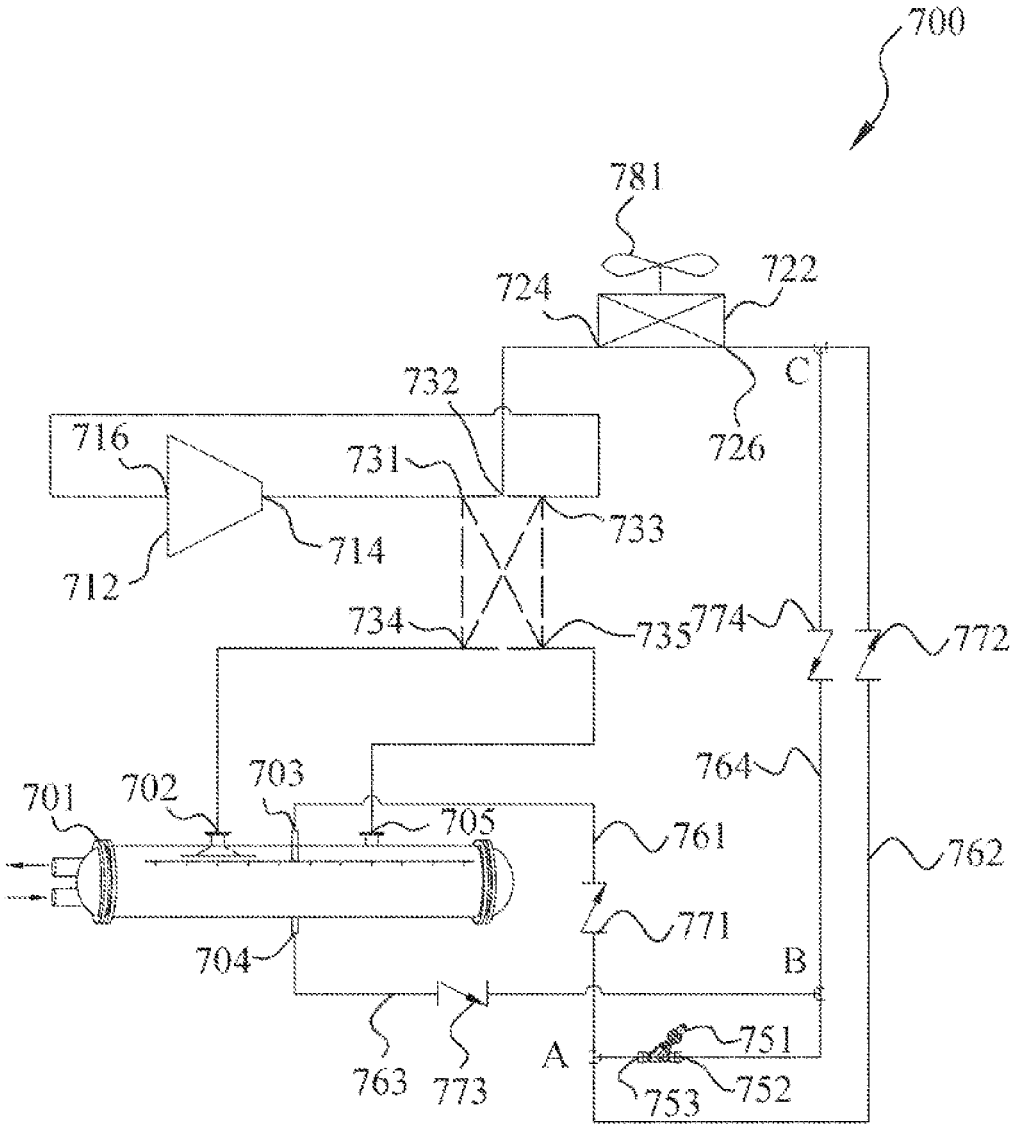
FIG. 7 is a system diagram of a heat pump system of one embodiment of the present application.

FIG. 7 shows a system diagram of a heat pump system 700 of the present application. As shown in FIG. 7, the heat pump system 700 comprises a compressor 712, a first heat exchanger 701, a second heat exchanger 722, a throttling device 751, and a valve device. The connection lines between various components (including the compressor 712, the first heat exchanger 701, the second heat exchanger 722, the throttling device 751 and the valve device) shown in FIG. 7 represent connecting pipelines.

As shown in FIG. 7, the compressor 712 comprises an air suction port 716 and an exhaust port 714. The first heat exchanger 701 is the heat exchanger 100 described in FIGS. 1-6B. The first heat exchanger is configured to be able to act as a falling film evaporator or a condenser. The first heat exchanger 701 comprises a first port of the first heat exchanger 702 (i.e., the second inlet pipe 114), a second port of the first heat exchanger 703 (i.e., the first inlet pipe 112), a third port of the first heat exchanger 704 (i.e., the second outlet pipe 122), and a fourth port of the first heat exchanger 705 (i.e., the first outlet pipe 124). The second heat exchanger 722 comprises a first port of the second heat exchanger 724 and a second port of the second heat exchanger 726. The valve device comprises a first connecting port of the valve device 731, a second connecting port of the valve device 732, a third connecting port of the valve device 733, a fourth connecting port of the valve device 734, and a fifth connecting port of the valve device 735. The throttling device 751 comprises an inlet of the throttling device 752 and an outlet of the throttling device 753. Specifically, the first connecting port of the valve device 731 is connected to the exhaust port 714 of the compressor 712 through a connecting pipeline, the second connecting port of the valve device 732 is connected to the first port of the second heat exchanger 724 through a connecting pipeline, the third connecting port of the valve device 733 is connected to the air suction port 716 of the compressor 712 through a connecting pipeline, the fourth connecting port of the valve device 734 is connected to the first port of the first heat exchanger 702 through a connecting pipeline, and the fifth connecting port of the valve device 735 is connected to the fourth port of the first heat exchanger 705 through a connecting pipeline. The second port of the first heat exchanger 703 and the second port of the second heat exchanger 726 are connected to the outlet of the throttling device 753 through connecting pipelines. Specifically, the second port of the first heat exchanger 703 communicates with the outlet of the throttling device 753 through a first connecting pipeline 761. The second port of the second heat exchanger 726 is connected to the outlet of the throttling device 753 through a second connecting pipeline 762. The first connecting pipeline 761 and the second connecting pipeline 762 merge at the position of an intersection point A and are then connected to the outlet of the throttling device 753. The third port of the first heat exchanger 704 and the second port of the second heat exchanger 726 communicate with the inlet of the throttling device 752 through connecting pipelines. Specifically, the third port of the first heat exchanger 704 is connected to the inlet of the throttling device 752 through a third connecting pipeline 763. The second port of the second heat exchanger 726 is connected to the inlet of the throttling device 752 through a fourth connecting pipeline 764. The third connecting pipeline 763 and the fourth connecting pipeline 764 merge at the position of an intersection point B and are then connected to the inlet of the throttling device 752. The second connecting pipeline 762 and the fourth connecting pipeline 764 merge at the position of an intersection point C.

Each of the first connecting pipeline 761, the second connecting pipeline 762, the third connecting pipeline 763 and the fourth connecting pipeline 764 is provided with a one-way valve. Specifically, the first connecting pipeline 761 is provided with a one-way valve 771 for allowing the refrigerants to be able to flow from the intersection point A to the second port of the first heat exchanger 703 in one direction. The second connecting pipeline 762 is provided with a one-way valve 772 for allowing the refrigerants to flow from the intersection point A to the intersection point C in one direction. The third connecting pipeline 763 is provided with a one-way valve 773 for allowing the refrigerants to be able to flow from the third port of the first heat exchanger 704 to the intersection point B in one direction. The fourth connecting pipeline 764 is provided with a one-way valve 774 for allowing the refrigerants to be able to flow from the intersection point C to the intersection point B in one direction.

However, those skilled in the art can understand that the one-way valves on the first connecting pipeline 761, the second connecting pipeline 762, the third connecting pipeline 763 and the fourth connecting pipeline 764 may also be set as other types of valves that can controllably communicate or disconnect upstream and downstream parts of the valves.

In the embodiment of the present application, the first heat exchanger 701 is a water-side heat exchanger. When acting as a condenser, the first heat exchanger can be used to provide hot water for users. The first heat exchanger may also act as an evaporator for use. The second heat exchanger 722 is an air-side heat exchanger. The second heat exchanger comprises a fan 781. The second heat exchanger can act as a condenser/evaporator to dissipate heating capacity/cooling capacity to the outside world.

Those skilled in the art can understand that the above types of the first heat exchanger 701 and the second heat exchanger 722 are only illustrative. In other examples, the first heat exchanger 701 and the second heat exchanger 722 can be any form of heat exchangers. For example, the second heat exchanger 722 may be a ground source heat exchanger, a water source heat exchanger, etc.

As shown in FIG. 7, the valve device is configured to: when the heat pump system is operating in the refrigeration mode, the valve device communicates the third connecting port of the valve device 733 with the air suction port 716 of the compressor 712, so that the first heat exchanger 701 acts as the falling film evaporator. When the heat pump system is operating in the heating mode, the valve device communicates the first connecting port of the valve device 731 with the exhaust port 714 of the compressor 712, so that the first heat exchanger 701 acts as the condenser.

Figure 8:
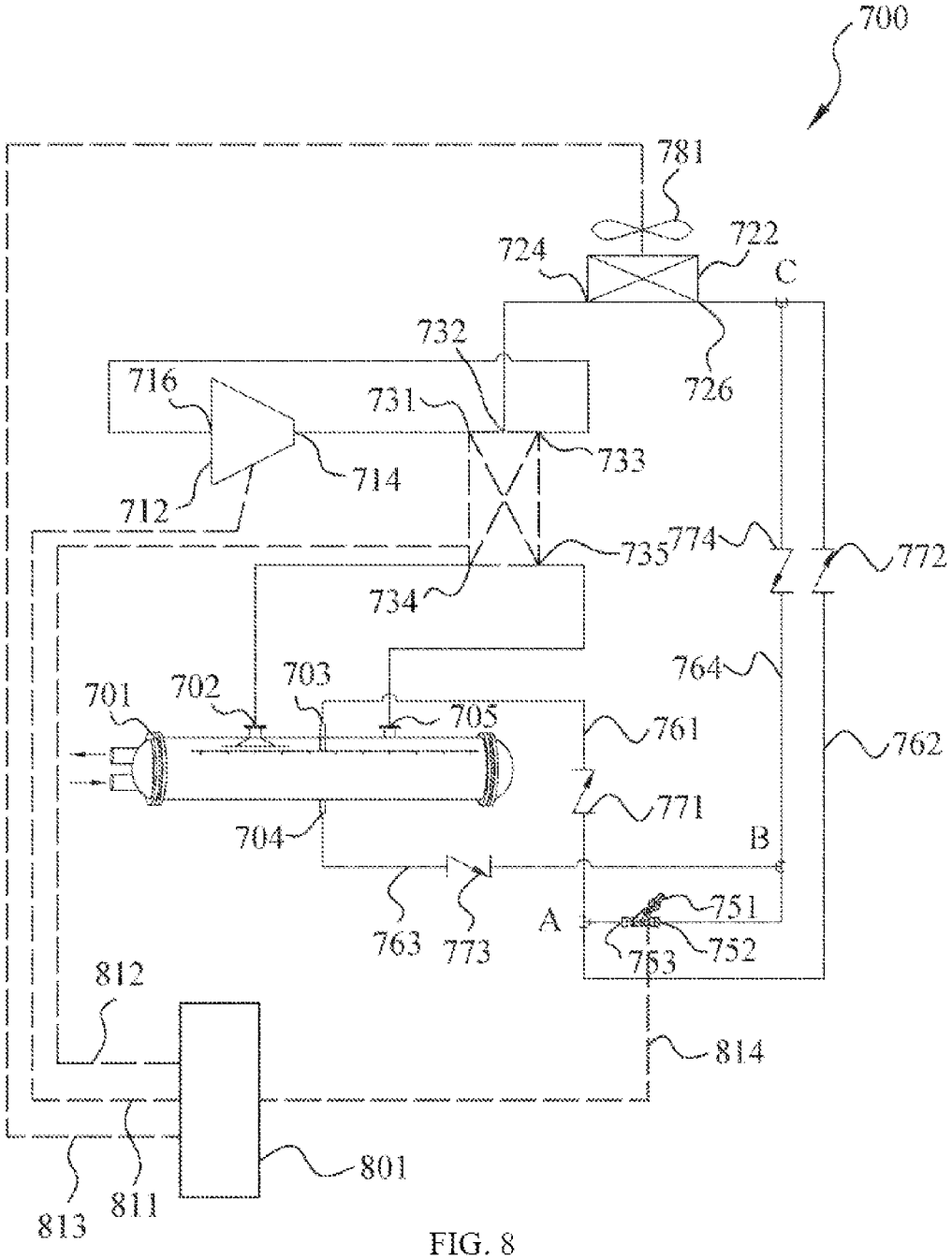
FIG. 8 is a schematic diagram of a communicative connection between a control device and various components in the heat pump system shown in FIG. 7.

FIG. 8 is a schematic diagram of a communicative connection between a control device 801 and various components in the heat pump system 700 shown in FIG. 7. As shown in FIG. 8, the heat pump system 700 comprises the control device 801. The control device 801 is connected to the compressor 712, the valve device, the fan 781 and the throttling device 751 through communicative connections 811, 812, 813, and 814, respectively. Wherein the control device 801 can control the on and off of the compressor 712, control the on and off of the fan 781, control the on and off of the throttling device 751, and control the valve device to select communication states of various connecting ports of the valve device in the valve device.

Figure 9:
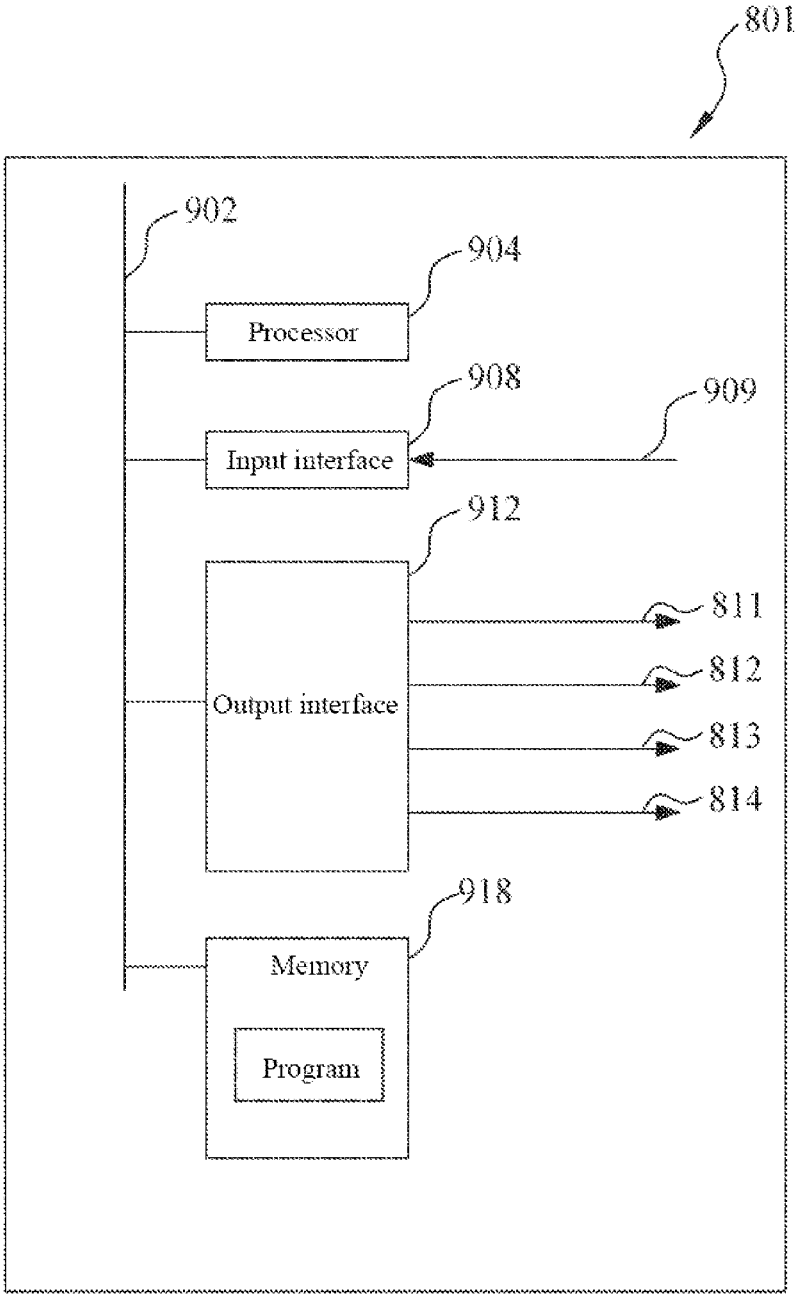
FIG. 9 is a schematic internal structure diagram of the control device in FIG. 8.

FIG. 9 is a schematic internal structure diagram of the control device 801 in FIG. 8. As shown in FIG. 9, the control device 801 comprises a bus 902, a processor 904, an input interface 908, an output interface 912, and a memory 918 with a control program. Various components (including the processor 904, the input interface 908, the output interface 912 and the memory 918) in the control device 801 are communicatively connected to the bus 902, so that the processor 904 can control the operation of the input interface 908, the output interface 912 and the memory 918. Specifically, the memory 918 is configured to store programs, instructions, and data, and the processor 904 reads the programs, the instructions, and the data from the memory 918 and can write the data into the memory 918. By executing reading of the programs and the instructions from the memory 918, the processor 904 controls the operation of the input interface 908 and the output interface 912. As shown in FIG. 9, the output interface 912 is communicatively connected to the compressor 712, the valve device, the fan 781 and the throttling device 751 through the communicative connections 811, 812, 813, and 814, respectively. The input interface 908 receives an operation request and other operation parameters of the heat pump system 700 through the communicative connection 909. By executing the programs and the instructions in the memory 918, the processor 904 controls the operation of the heat pump system 700. More specifically, the control device 801 may receive and control the operation request of the heat pump system 700 through the input interface 908 (such as sending a request through a control panel), and send a control signal to each controlled component through the output interface 912, so that the heat pump system 700 can operate in multiple operating modes and may be switched between various operating modes.

The present application provides five embodiments of the valve device, which will be introduced in conjunction with FIGS. 10A-14D, respectively.

Figure 10A:
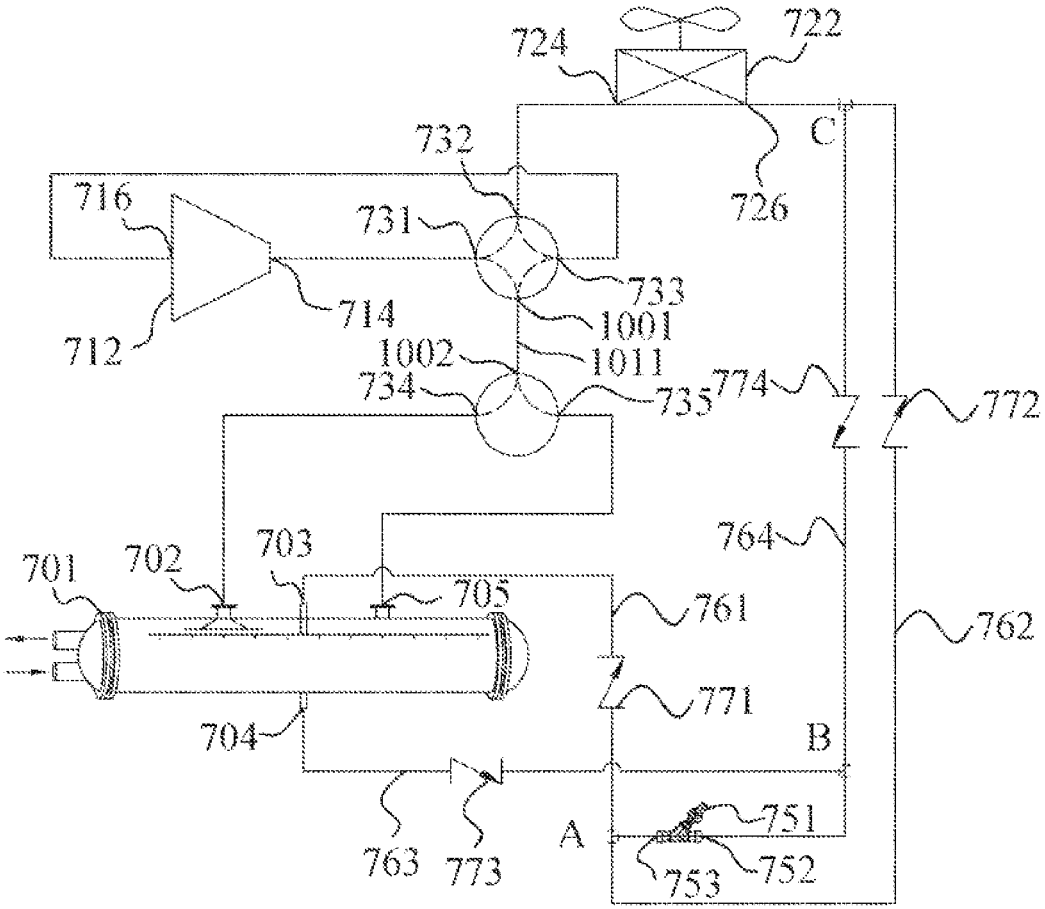
FIG. 10A is a system diagram of a heat pump system using a valve assembly of a first embodiment.

FIG. 10A is a system diagram of a heat pump system using a valve device of a first embodiment. In the system diagram shown in FIG. 10A, the valve device comprises a four-way valve and a three-way valve. The four-way valve comprises four ports, three of which form the first connecting port of the valve device 731, the second connecting port of the valve device 732, and the third connecting port of the valve device 733, respectively. The three-way valve comprises three ports, two of which form the fourth connecting port of the valve device 734 and the fifth connecting port of the valve device 735, respectively. A fourth port 1001 of the four-way valve is connected to a third port 1002 of the three-way valve through a connecting pipeline 1011. The four-way valve comprises a first pair of circulation channels of the four-way valve and a second pair of circulation channels of the four-way valve. The first pair of circulation channels of the four-way valve can enable the first connecting port of the valve device 731 to be in refrigerant communication with the second connecting port of the valve device 732, and can enable the third connecting port of the valve device 733 to be in refrigerant communication with the fourth port 1001 of the four-way valve. The second pair of circulation channels of the four-way valve can enable the first connecting port of the valve device 731 to be in refrigerant communication with the fourth port 1001 of the four-way valve, and can enable the second connecting port of the valve device 732 to be in refrigerant communication with the third connecting port of the valve device 733. The three-way valve comprises a first circulation channel of the three-way valve and a second circulation channel of the three-way valve. The third port 1002 of the three-way valve can be in refrigerant communication with the fourth connecting port of the valve device 734 through the first circulation channel of the three-way valve, or the third port 1002 of the three-way valve can be in refrigerant communication with the fifth connecting port of the valve device 735 through the second circulation channel of the three-way valve.

Figure 10B:
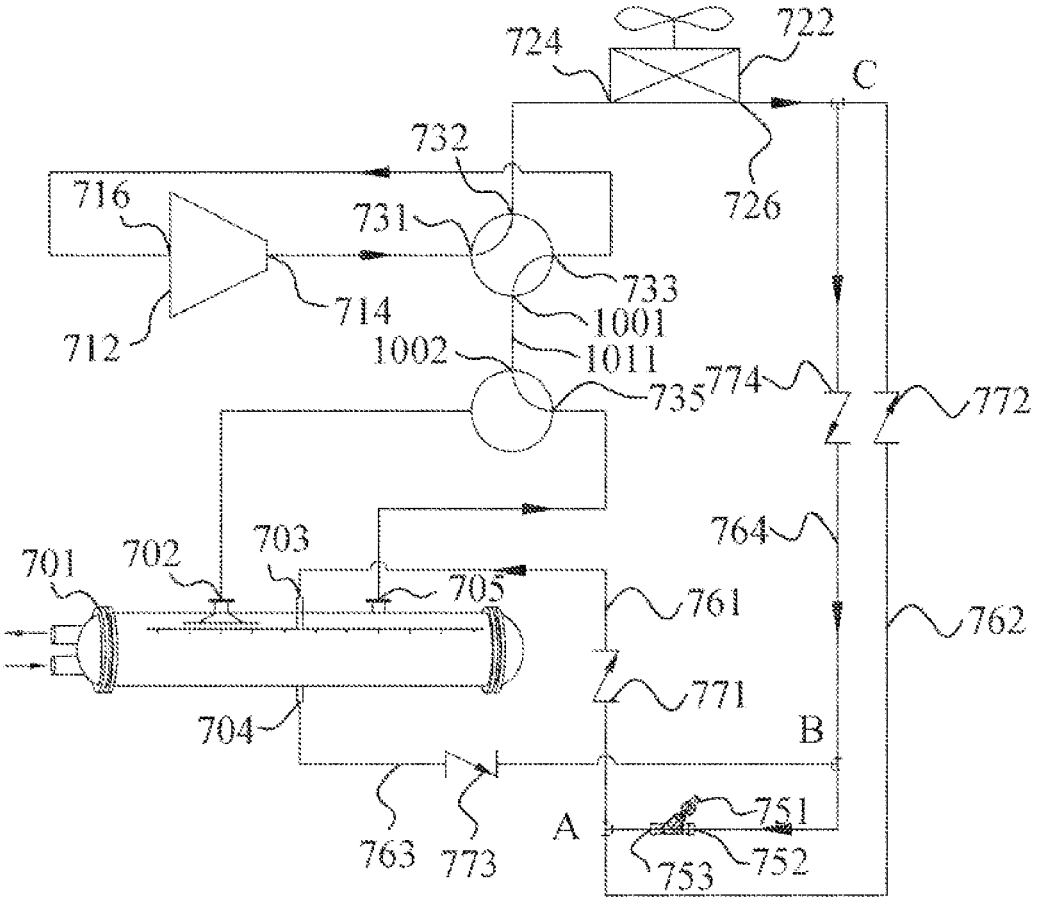
FIG. 10B is a system diagram of the heat pump system shown in FIG. 10A in a refrigeration mode.

FIG. 10B is a system diagram of the heat pump system shown in FIG. 10A in the refrigeration mode. As shown in FIG. 10B, through the control of the control device 801, the four-way valve is in a state of the first pair of circulation channels of the four-way valve, the three-way valve is in a state of the second circulation channel of the three-way valve, and the compressor 712, the fan 781 and the throttling device 751 are turned on.

Specifically, the high-temperature and high-pressure gaseous refrigerants flowing out from the exhaust port 714 of the compressor 712 pass through the first connecting port of the valve device 731 and the second connecting port of the valve device 732 in sequence to flow to the second heat exchanger 722. In the second heat exchanger 722, the high-temperature and high-pressure gaseous refrigerants exchange heat with the air, thereby changing the high-temperature and high-pressure gaseous refrigerants into high-pressure liquid refrigerants. The high-pressure liquid refrigerants flow out of the second heat exchanger 722 and then pass through the intersection point C, the one-way valve 774, the intersection point B, and the throttling device 751 in sequence. The high-pressure liquid refrigerants become low-temperature and low-pressure refrigerants after flowing through the throttling device 751, then pass through the intersection point A and the one-way valve 771 in sequence, and enter the first heat exchanger 701 from the second port of the first heat exchanger 703. In the first heat exchanger 701, the low-temperature and low-pressure refrigerants exchange heat with the refrigerants at a relatively high temperature on a user side, thereby reducing the temperature of the refrigerants on the user side to provide the refrigerants at a relatively low temperature for the user side (for example, for providing air-conditioning cold water). The low-temperature and low-pressure refrigerants exchange heat with the refrigerants on the user side in the first heat exchanger 701 and then become low-pressure gaseous refrigerants. After the low-pressure gaseous refrigerants flow out of the first heat exchanger 701 from the fourth port of the first heat exchanger 705, the low-pressure gaseous refrigerants pass through the fifth connecting port of the valve device 735, the third port 1002 of the three-way valve, the connecting pipeline 1011, the fourth port 1001 of the four-way valve and the third connecting port of the valve device 733 in sequence and then enter the compressor 712 again from the air suction port 716 of the compressor 712 to become high-temperature and high-pressure gaseous refrigerants to complete the cycle of the refrigerants.

Figure 10C:
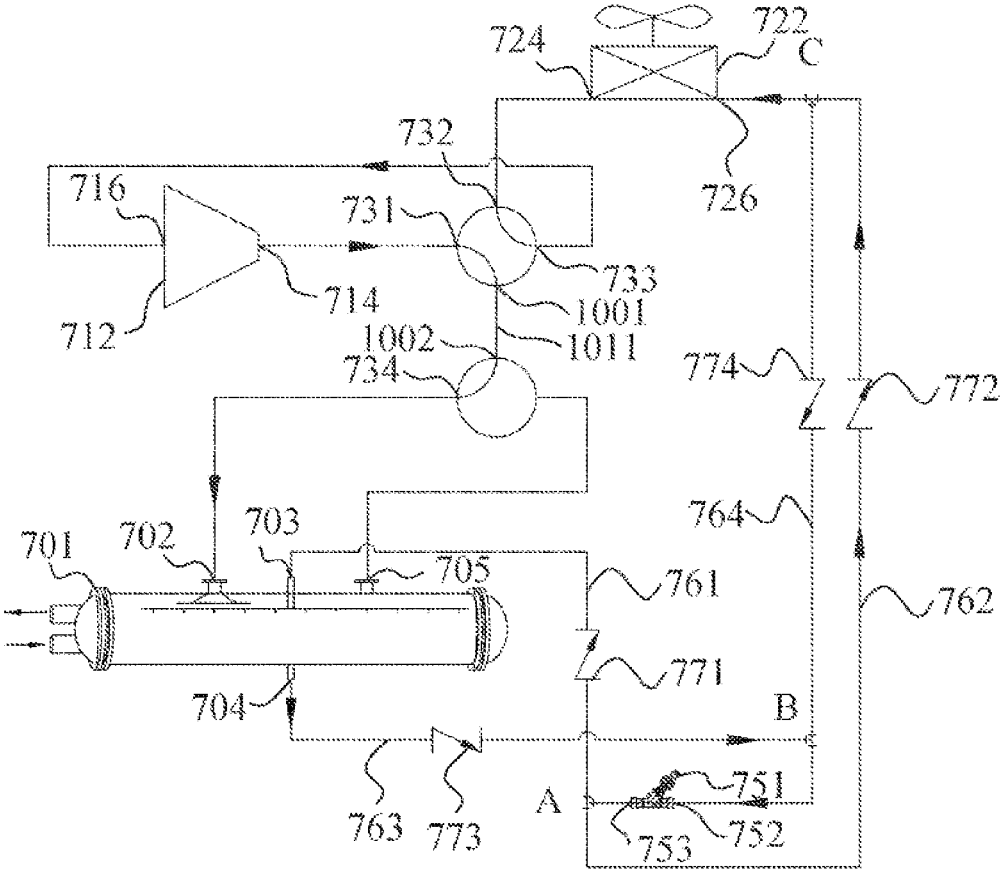
FIG. 10C is a system diagram of the heat pump system shown in FIG. 10A in a heating mode.

FIG. 10C is a system diagram of the heat pump system shown in FIG. 10A in the heating mode. As shown in FIG. 10C, through the control of the control device 801, the four-way valve is in a state of the second pair of circulation channels of the four-way valve, the three-way valve is in a state of the first circulation channel of the three-way valve, and the compressor 712, the fan 781 and the throttling device 751 are turned on.

Specifically, the high-temperature and high-pressure gaseous refrigerants flowing out from the exhaust port 714 of the compressor 712 pass through the first connecting port of the valve device 731, the fourth port 1001 of the four-way valve, the connecting pipeline 1011 and the fourth connecting port of the valve device 734 in sequence, and then flow into the first heat exchanger 701 from the first port of the first heat exchanger 702. In the first heat exchanger 701, the high-temperature and high-pressure gaseous refrigerants exchange heat with the refrigerants at a relatively low temperature on the user side, thereby increasing the temperature of the refrigerants on the user side to provide the refrigerants at a relatively high temperature for the user (for example, for providing air-conditioning hot water). The high-temperature and high-pressure gaseous refrigerants exchange heat with the refrigerants on the user side in the first heat exchanger 701 and then become high-pressure liquid refrigerants. The high-pressure liquid refrigerants flow out from the third port of the first heat exchanger 704 of the first heat exchanger 701 and then pass through the one-way valve 773, the intersection point B and the throttling device 751 in sequence. The high-pressure liquid refrigerants become low-temperature and low-pressure refrigerants after flowing through the throttling device 751, and then pass through the intersection point A, the one-way valve 772 and the intersection point C in sequence to flow to the second heat exchanger 722. In the second heat exchanger 722, the low-temperature and low-pressure refrigerants exchange heat with the air, thereby changing the low-temperature and low-pressure refrigerants into low-pressure gaseous refrigerants. The low-pressure gaseous refrigerants pass through the second connecting port of the valve device 732 and the third connecting port of the valve device 733 in sequence, and then enter the compressor 712 again from the air suction port 716 of the compressor 712 to become high-temperature and high-pressure gaseous refrigerants to complete the cycle of the refrigerants.

Figure 11A:
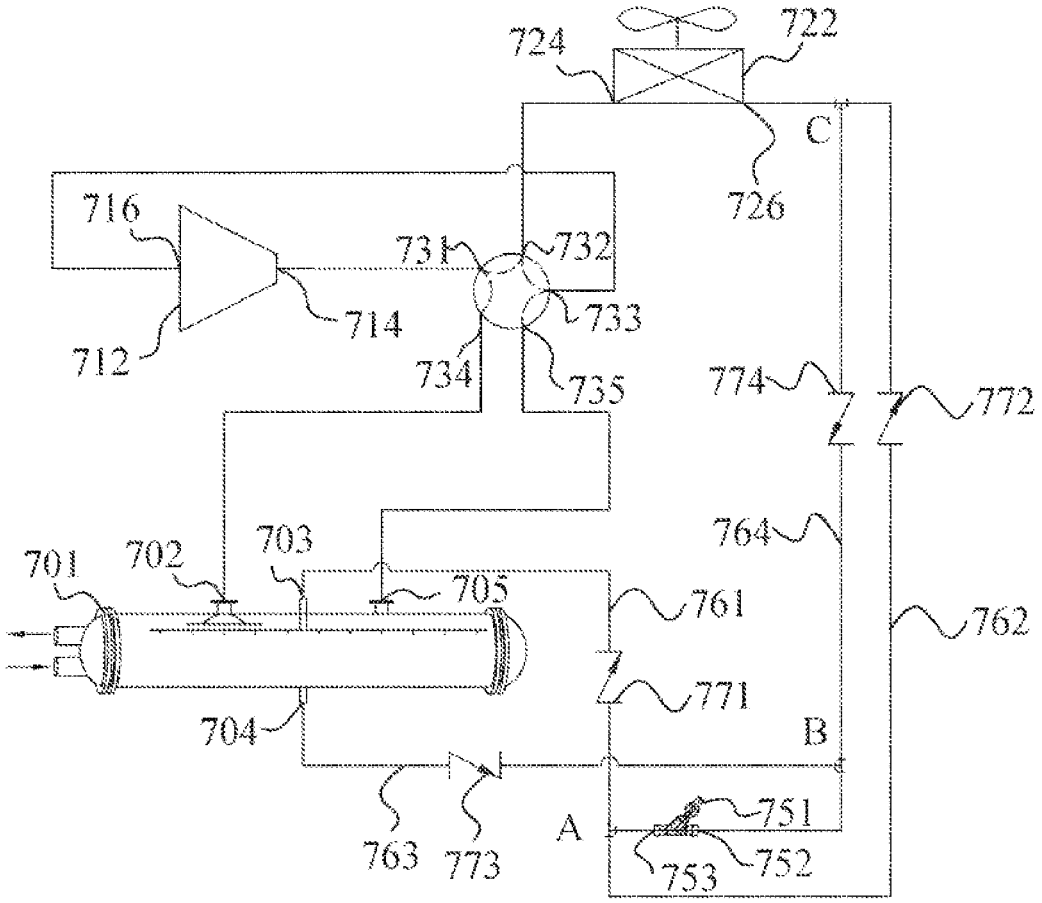
FIG. 11A is a system diagram of a heat pump system using a valve assembly of a second embodiment.

FIG. 11A is a system diagram of a heat pump system using a valve device of a second embodiment. In the system diagram shown in FIG. 11A, the valve device comprises a five-way valve. The five-way valve comprises five ports, which form a first connecting port of the valve device 731, a second connecting port of the valve device 732, a third connecting port of the valve device 733, a fourth connecting port of the valve device 734, and a fifth connecting port of the valve device 735, respectively. The five-way valve comprises a first circulation channel of the five-way valve and a second circulation channel of the five-way valve, and has a first state and a second state. When the five-way valve is in the first state, the first connecting port of the valve device 731 is in refrigerant communication with the second connecting port of the valve device 732, and the third connecting port of the valve device 733 is in refrigerant communication with the fifth connecting port of the valve device 735. When the five-way valve is in the second state, the first connecting port of the valve device 731 is in refrigerant communication with the fourth connecting port of the valve device 734, and the second connecting port of the valve device 732 is in refrigerant communication with the third connecting port of the valve device 733.

Figure 11B:
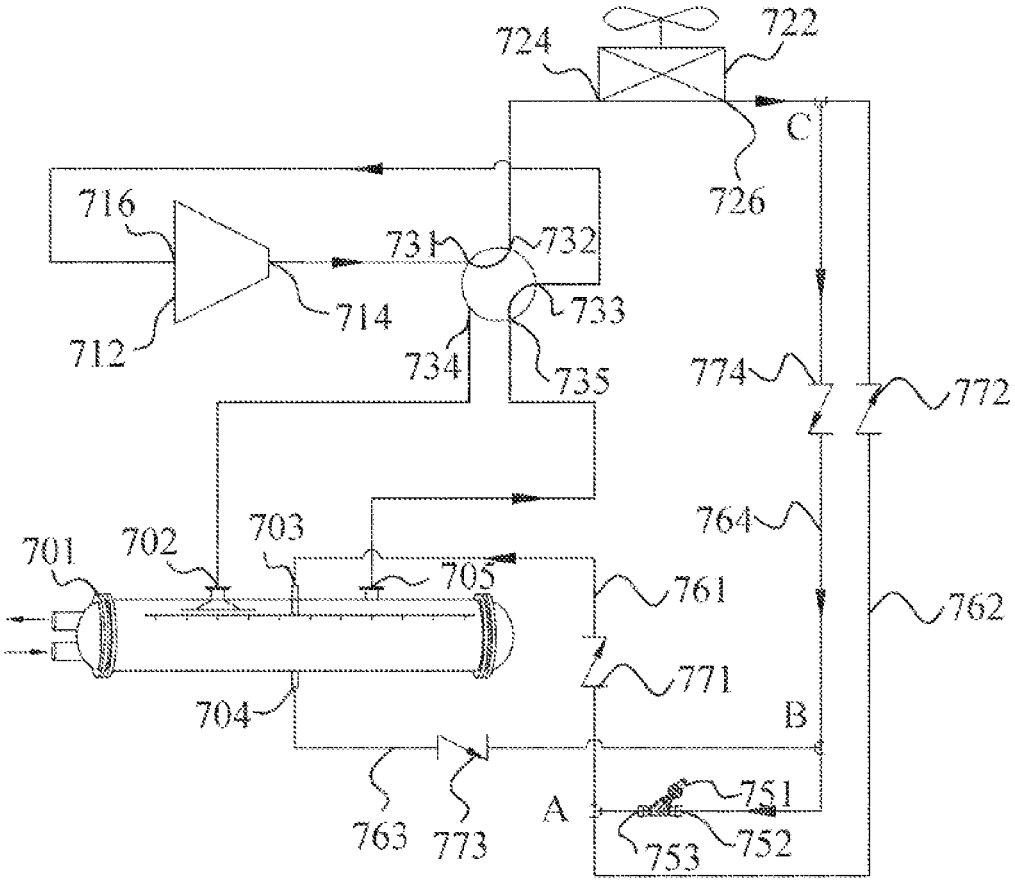
FIG. 11B is a system diagram of the heat pump system shown in FIG. 11A in a refrigeration mode.

FIG. 11B is a system diagram of the heat pump system shown in FIG. 11A in the refrigeration mode. As shown in FIG. 11B, through the control of the control device 801, the five-way valve is in the first state, and the compressor 712, the fan 781 and the throttling device 751 are turned on.

Specifically, the high-temperature and high-pressure gaseous refrigerants flowing out from the exhaust port 714 of the compressor 712 pass through the first connecting port of the valve device 731 and the second connecting port of the valve device 732 in sequence to flow to the second heat exchanger 722. In the second heat exchanger 722, the high-temperature and high-pressure gaseous refrigerants exchange heat with the air, thereby changing the high-temperature and high-pressure gaseous refrigerants into high-pressure liquid refrigerants. The high-pressure liquid refrigerants flow out of the second heat exchanger 722 and then pass through the intersection point C, the one-way valve 774, the intersection point B, and the throttling device 751 in sequence. The high-pressure liquid refrigerants become low-temperature and low-pressure refrigerants after flowing through the throttling device 751, then pass through the one-way valve 771 and enter the first heat exchanger 701 from the second port of the first heat exchanger 703. In the first heat exchanger 701, the low-temperature and low-pressure refrigerants exchange heat with the refrigerants at a relatively high temperature on a user side, thereby reducing the temperature of the refrigerants on the user side to provide the refrigerants at a relatively low temperature for the user side (for example, for providing air-conditioning cold water). The low-temperature and low-pressure refrigerants exchange heat with the refrigerants on the user side in the first heat exchanger 701 and then become low-pressure gaseous refrigerants. After the low-pressure gaseous refrigerants flow out of the first heat exchanger 701 from the fourth port of the first heat exchanger 705, the low-pressure gaseous refrigerants pass through the fifth connecting port of the valve device 735 and the third connecting port of the valve device 733 in sequence, and then enter the compressor 712 from the air suction port 716 of the compressor 712 again to become high-temperature and high-pressure gaseous refrigerants to complete the cycle of the refrigerants.

Figure 11C:
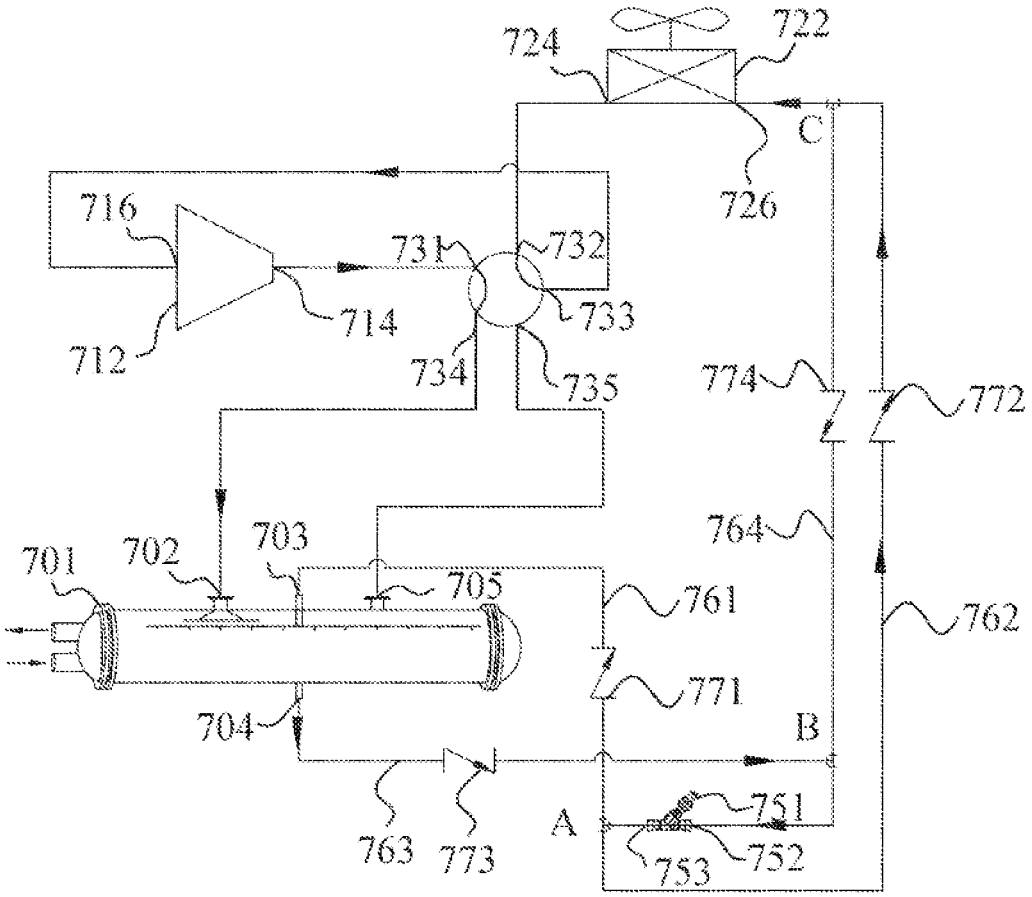
FIG. 11C is a system diagram of the heat pump system shown in FIG. 11A in a heating mode.

FIG. 11C is a system diagram of the heat pump system shown in FIG. 11A in the heating mode. As shown in FIG. 11C, through the control of the control device 801, the five-way valve is in the second state, and the compressor 712, the fan 781 and the throttling device 751 are turned on.

Specifically, the high-temperature and high-pressure gaseous refrigerants flowing out from the exhaust port 714 of the compressor 712 pass through the first connecting port of the valve device 731 and the fourth connecting port of the valve device 734 in sequence, and then flow into the first heat exchanger 701 from the first port of the first heat exchanger 702. In the first heat exchanger 701, the high-temperature and high-pressure gaseous refrigerants exchange heat with the refrigerants at a relatively low temperature on the user side, thereby increasing the temperature of the refrigerants on the user side to provide the refrigerants at a relatively high temperature for the user (for example, for providing air-conditioning hot water). The high-temperature and high-pressure gaseous refrigerants exchange heat with the refrigerants on the user side in the first heat exchanger 701 and then become high-pressure liquid refrigerants. The high-pressure liquid refrigerants flow out from the third port of the first heat exchanger 704 of the first heat exchanger 701 and then pass through the one-way valve 773, the intersection point B and the throttling device 751 in sequence. The high-pressure liquid refrigerants become low-temperature and low-pressure refrigerants after flowing through the throttling device 751, and then pass through the intersection point A, the one-way valve 772 and the intersection point C in sequence to flow to the second heat exchanger 722. In the second heat exchanger 722, the low-temperature and low-pressure refrigerants exchange heat with the air, thereby changing the low-temperature and low-pressure refrigerants into low-pressure gaseous refrigerants. The low-pressure gaseous refrigerants pass through the second connecting port of the valve device 732 and the third connecting port of the valve device 733 in sequence, and then enter the compressor 712 again from the air suction port 716 of the compressor 712 to become high-temperature and high-pressure gaseous refrigerants to complete the cycle of the refrigerants.

Figure 12A:
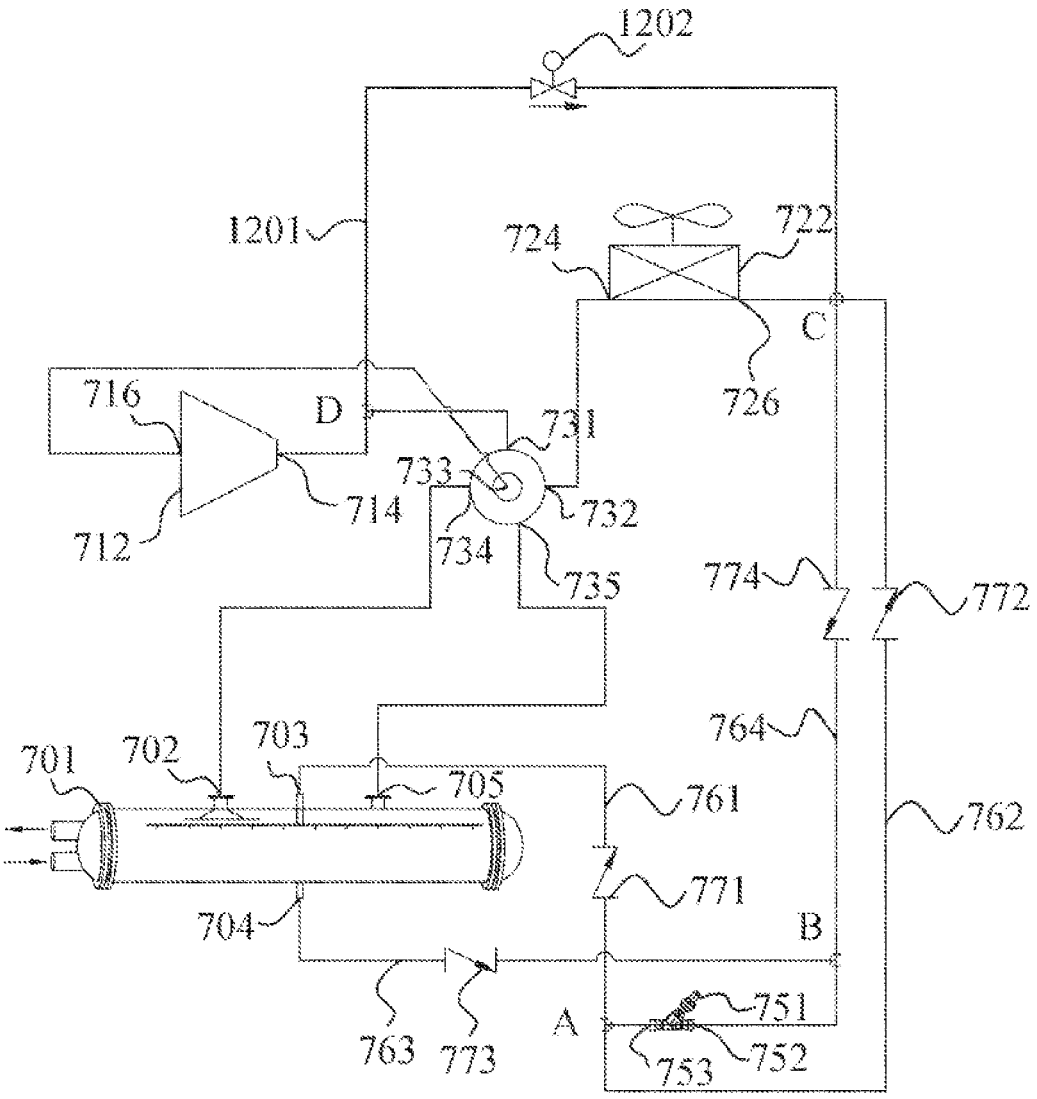
FIG. 12A is a system diagram of a heat pump system using a valve assembly of a third embodiment.

FIG. 12A is a system diagram of a heat pump system using a valve device of a third embodiment. In the system diagram shown in FIG. 12A, the valve device comprises a five-way valve. The five-way valve comprises five ports, which form a first connecting port of the valve device 731, a second connecting port of the valve device 732, a third connecting port of the valve device 733, a fourth connecting port of the valve device 734, and a fifth connecting port of the valve device 735, respectively. The five-way valve comprises a first circulation channel of the five-way valve and a second circulation channel of the five-way valve, and has a first state, a second state, a third state, and a fourth state. When the five-way valve is in the first state, the first connecting port of the valve device 731 is in refrigerant communication with the second connecting port of the valve device 732, and the third connecting port of the valve device 733 is in refrigerant communication with the fifth connecting port of the valve device 735. When the five-way valve is in the second state, the first connecting port of the valve device 731 is in refrigerant communication with the fourth connecting port of the valve device 734, and the second connecting port of the valve device 732 is in refrigerant communication with the third connecting port of the valve device 733. When the five-way valve is in the third state, the first connecting port of the valve device 731 is in refrigerant communication with the third connecting port of the valve device 733, and the fourth connecting port of the valve device 734 is in refrigerant communication with the fifth connecting port of the valve device 735. When the five-way valve is in the fourth state, the second connecting port of the valve device 732 is in refrigerant communication with the fifth connecting port of the valve device 735, and the third connecting port of the valve device 733 is in refrigerant communication with the fourth connecting port of the valve device 734.

The heat pump system shown in FIG. 12A is approximately the same as the heat pump system shown in FIG. 11A, which will not be described again here. The difference is that the heat pump system shown in FIG. 12A further comprises a communication pipe 1201, and the communication pipe 1201 is configured to controllably communicate the exhaust port 714 of the compressor 712 with the second port of the second heat exchanger 726. Specifically, one end of the communication pipe 1201 is connected to the intersection point D of the connecting pipelines between the exhaust port 714 of the compressor 712 and the first connecting port of the valve device 731, and the other end of the communication pipe 1201 is connected to the intersection point C. In addition, the communication pipe 1201 is also provided with a one-way solenoid valve 1202, which is communicatively connected with the control device 801. The one-way solenoid valve 1202 can enable the refrigerants to flow from the intersection point D to the intersection point C in one direction.

Figure 12B:
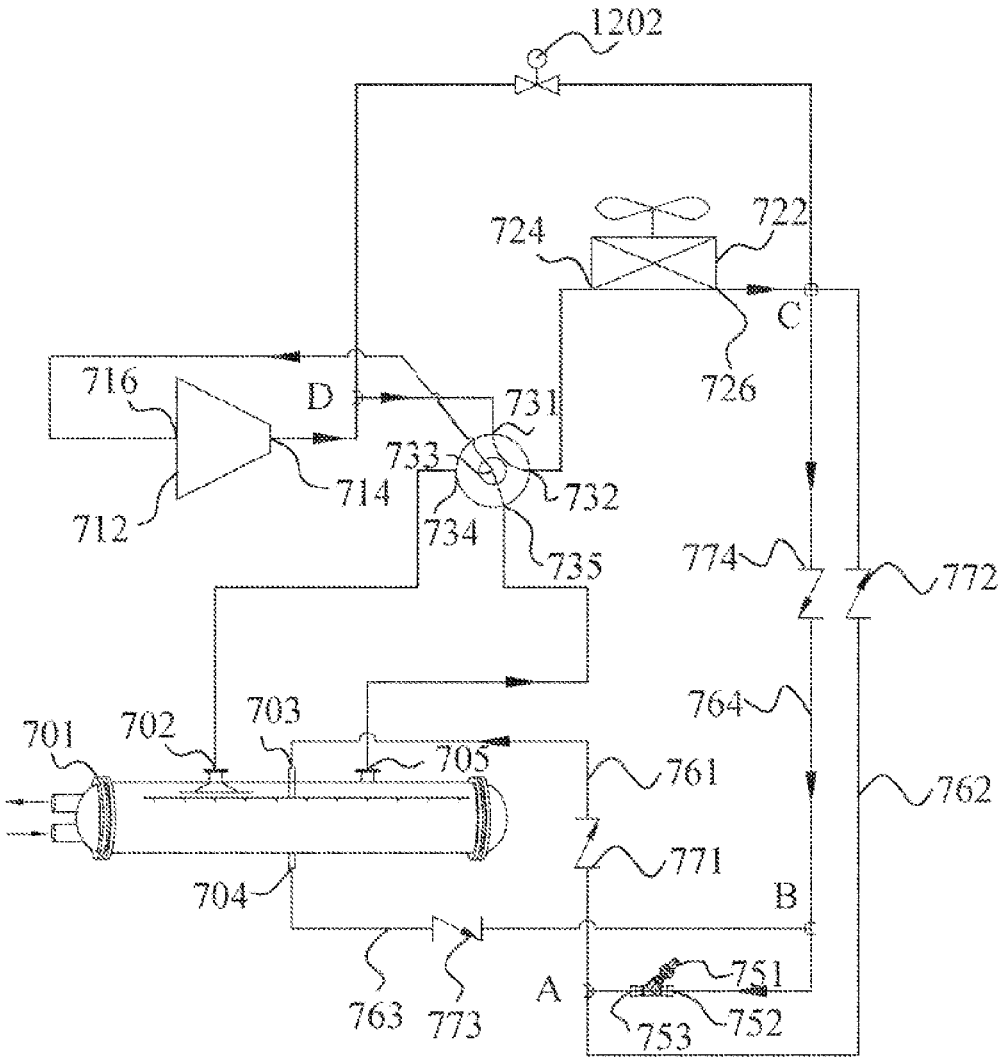
FIG. 12B is a system diagram of the heat pump system shown in FIG. 12A in a refrigeration mode.

FIG. 12B is a system diagram of the heat pump system shown in FIG. 12A in the refrigeration mode. As shown in FIG. 12B, through the control of the control device 801, the five-way valve is in the first state, the compressor 712, the fan 781 and the throttling device 751 are turned on, and the one-way solenoid valve 1202 is turned off.

Specifically, the high-temperature and high-pressure gaseous refrigerants flowing out from the exhaust port 714 of the compressor 712 pass through the intersection point D, the first connecting port of the valve device 731 and the second connecting port of the valve device 732 in sequence to flow to the second heat exchanger 722. In the second heat exchanger 722, the high-temperature and high-pressure gaseous refrigerants exchange heat with the air, thereby changing the high-temperature and high-pressure gaseous refrigerants into high-pressure liquid refrigerants. The high-pressure liquid refrigerants flow out of the second heat exchanger 722 and then pass through the intersection point C, the one-way valve 774, the intersection point B, and the throttling device 751 in sequence. The high-pressure liquid refrigerants become low-temperature and low-pressure refrigerants after flowing through the throttling device 751, then pass through the one-way valve 771 and enter the first heat exchanger 701 from the second port of the first heat exchanger 703. In the first heat exchanger 701, the low-temperature and low-pressure refrigerants exchange heat with the refrigerants at a relatively high temperature on a user side, thereby reducing the temperature of the refrigerants on the user side to provide the refrigerants at a relatively low temperature for the user side (for example, for providing air-conditioning cold water). The low-temperature and low-pressure refrigerants exchange heat with the refrigerants on the user side in the first heat exchanger 701 and then become low-pressure gaseous refrigerants. After the low-pressure gaseous refrigerants flow out of the first heat exchanger 701 from the fourth port of the first heat exchanger 705, the low-pressure gaseous refrigerants pass through the fifth connecting port of the valve device 735 and the third connecting port of the valve device 733 in sequence, and then enter the compressor 712 from the air suction port 716 of the compressor 712 again to become high-temperature and high-pressure gaseous refrigerants to complete the cycle of the refrigerants.

Figure 12C:
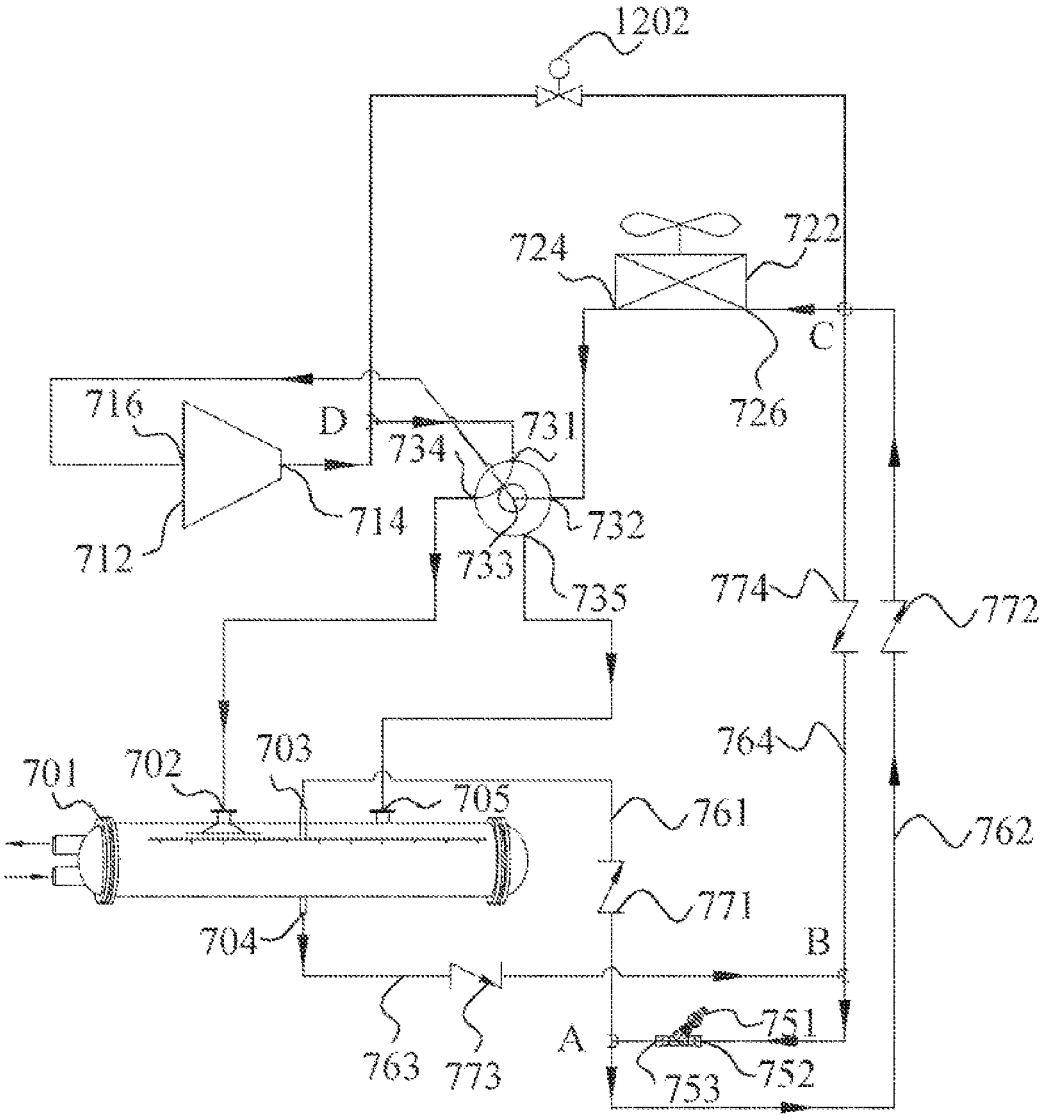
FIG. 12C is a system diagram of the heat pump system shown in FIG. 12A in a heating mode.

FIG. 12C is a system diagram of the heat pump system shown in FIG. 12A in the heating mode. As shown in FIG. 12C, through the control of the control device 801, the five-way valve is in the second state, the compressor 712, the fan 781 and the throttling device 751 are turned on, and the one-way solenoid valve 1202 is turned off.

Specifically, the high-temperature and high-pressure gaseous refrigerants flowing out from the exhaust port 714 of the compressor 712 pass through the intersection point D, the first connecting port of the valve device 731, and the fourth connecting port of the valve device 734 in sequence, and then flow into the first heat exchanger 701 from the first port of the first heat exchanger 702. In the first heat exchanger 701, the high-temperature and high-pressure gaseous refrigerants exchange heat with the refrigerants at a relatively low temperature on the user side, thereby increasing the temperature of the refrigerants on the user side to provide the refrigerants at a relatively high temperature for the user (for example, for providing air-conditioning hot water). The high-temperature and high-pressure gaseous refrigerants exchange heat with the refrigerants on the user side in the first heat exchanger 701 and then become high-pressure liquid refrigerants. The high-pressure liquid refrigerants flow out from the third port of the first heat exchanger 704 of the first heat exchanger 701 and then pass through the one-way valve 773, the intersection point B and the throttling device 751 in sequence. The high-pressure liquid refrigerants become low-temperature and low-pressure refrigerants after flowing through the throttling device 751, and then pass through the intersection point A, the one-way valve 772 and the intersection point C in sequence to flow to the second heat exchanger 722. In the second heat exchanger 722, the low-temperature and low-pressure refrigerants exchange heat with the air, thereby changing the low-temperature and low-pressure refrigerants into low-pressure gaseous refrigerants. The low-pressure gaseous refrigerants pass through the second connecting port of the valve device 732 and the third connecting port of the valve device 733 in sequence, and then enter the compressor 712 again from the air suction port 716 of the compressor 712 to become high-temperature and high-pressure gaseous refrigerants to complete the cycle of the refrigerants.

Figure 12D:
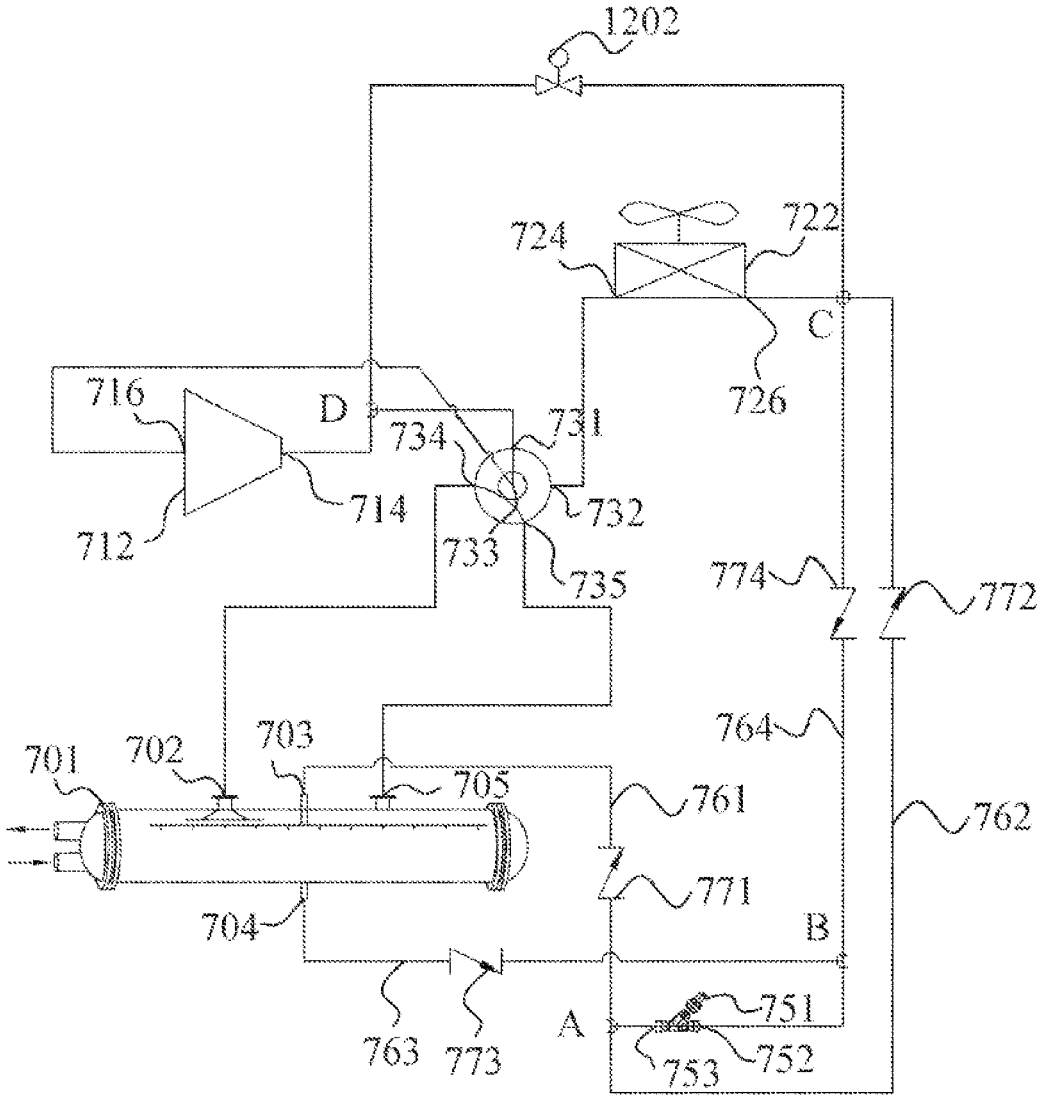
FIG. 12D is a system diagram of the heat pump system shown in FIG. 12A in an isolation mode.

FIG. 12D is a system diagram of the heat pump system shown in FIG. 12A in an isolation mode. As shown in FIG. 12D, through the control of the control device 801, the five-way valve is in the third state, the compressor 712, the fan 781 and the throttling device 751 are turned off, and the one-way solenoid valve 1202 is turned off.

Specifically, when the compressor 712 is turned off, the heat pump system is in a shutdown state. At this time, since the five-way valve is in the third state, the first port of the second heat exchanger 724 of the second heat exchanger 722 is disconnected through the five-way valve, and the second port of the second heat exchanger 726 of the second heat exchanger 722 is disconnected from the first heat exchanger 701 through the throttling device 751 in a turned-off state. The first port of the first heat exchanger 702 and the fourth port of the first heat exchanger 705 are connected together through the fourth connecting port of the valve device 734 and the fifth connecting port of the valve device 735 of the five-way valve, and the third port of the first heat exchanger 704 is disconnected from the second heat exchanger 722 through the throttling device 751 in the turned-off state. The exhaust port 714 and the air suction port 716 of the compressor 712 are connected together through the first connecting port of the valve device 731 and the third connecting port of the valve device 733 of the five-way valve. Therefore, the first heat exchanger 701, the second heat exchanger 722 and the compressor 712 are disconnected from each other to prevent the refrigerants from migrating among the first heat exchanger 701, the second heat exchanger 722 and the compressor 712.

Figure 12E:
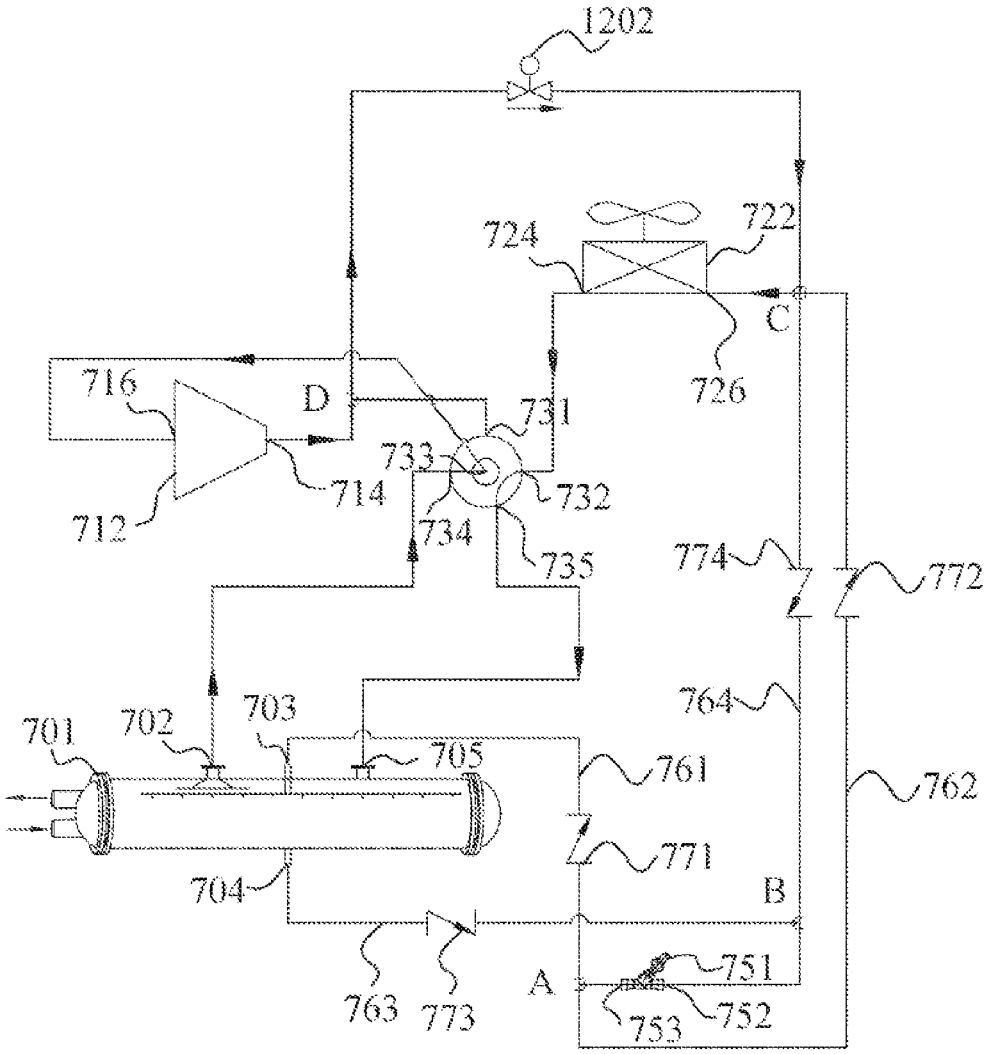
FIG. 12E is a system diagram of the heat pump system shown in FIG. 12A in a liquid drainage mode.

FIG. 12E is a system diagram of the heat pump system shown in FIG. 12A in a liquid drainage mode. As shown in FIG. 12E, through the control of the control device 801, the five-way valve is in the fourth state, the compressor 712 is turned on, the throttling device 751 and the fan 781 are turned off, and the one-way solenoid valve 1202 is turned on. It should be noted that the liquid drainage mode is a transition mode that the heat pump system is switched from the refrigeration mode to the heating mode. That is to say, when the heat pump system needs to be switched from the refrigeration mode to the heating mode, the heat pump system will first be switched to be in the liquid drainage mode and then be switched to be in the heating mode.

Specifically, the refrigerants flowing out from the exhaust port 714 of the compressor 712 pass through the intersection point D, the one-way solenoid valve 1202, the intersection point C, the second heat exchanger 722, the second connecting port of the valve device 732, and the fifth connecting port of the valve device 735, then flow into the first heat exchanger 701 from the fourth port of the first heat exchanger 705, and then flow out of the first heat exchanger 701 from the first port of the first heat exchanger 702. Finally, the refrigerants pass through the fourth connecting port of the valve device 734 and the third connecting port of the valve device 733 in sequence, and then enter the compressor 712 again from the air suction port 716 of the compressor 712 to complete the cycle of the refrigerants.

Therefore, the liquid drainage mode can realize direct communication between the second heat exchanger 722 and the first heat exchanger 701 without passing through the throttling device 751, thereby rapidly draining liquid refrigerants generated by defrosting (i.e., the refrigeration mode) in the second heat exchanger 722 into the first heat exchanger 701 to prevent the liquid refrigerants from directly entering the compressor 712 when the refrigeration mode is directly switched to the heating mode.

Figure 13A:
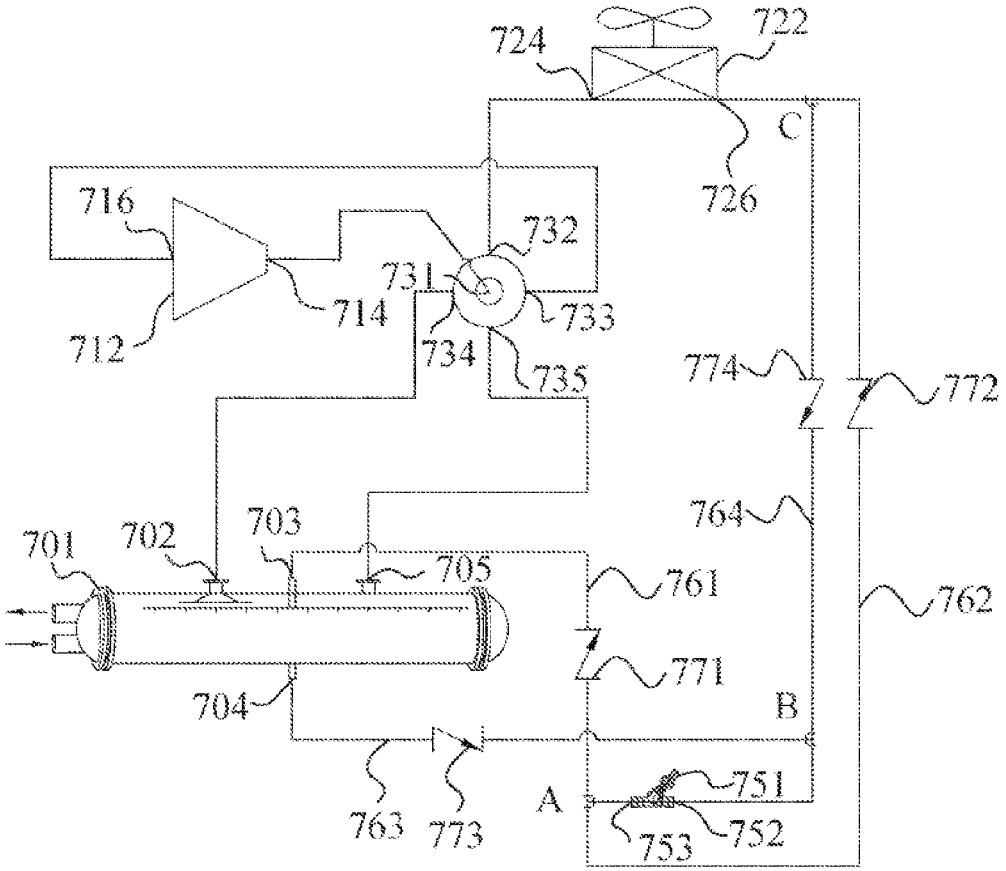
FIG. 13A is a system diagram of a heat pump system using a valve assembly of a fourth embodiment.

FIG. 13A is a system diagram of a heat pump system using a valve device of a fourth embodiment. In the system diagram shown in FIG. 13A, the valve device comprises a five-way valve. The five-way valve comprises five ports, which form a first connecting port of the valve device 731, a second connecting port of the valve device 732, a third connecting port of the valve device 733, a fourth connecting port of the valve device 734, and a fifth connecting port of the valve device 735, respectively. The five-way valve comprises a first circulation channel of the five-way valve and a second circulation channel of the five-way valve, and has a first state, a second state and a third state. When the five-way valve is in the first state, the first connecting port of the valve device 731 is in refrigerant communication with the second connecting port of the valve device 732, and the third connecting port of the valve device 733 is in refrigerant communication with the fifth connecting port of the valve device 735. When the five-way valve is in the second state, the first connecting port of the valve device 731 is in refrigerant communication with the fourth connecting port of the valve device 734, and the second connecting port of the valve device 732 is in refrigerant communication with the third connecting port of the valve device 733. When the five-way valve is in the third state, the first connecting port of the valve device 731 is in refrigerant communication with the third connecting port of the valve device 733, and the fourth connecting port of the valve device 734 is in refrigerant communication with the fifth connecting port of the valve device 735.

Figure 13B:
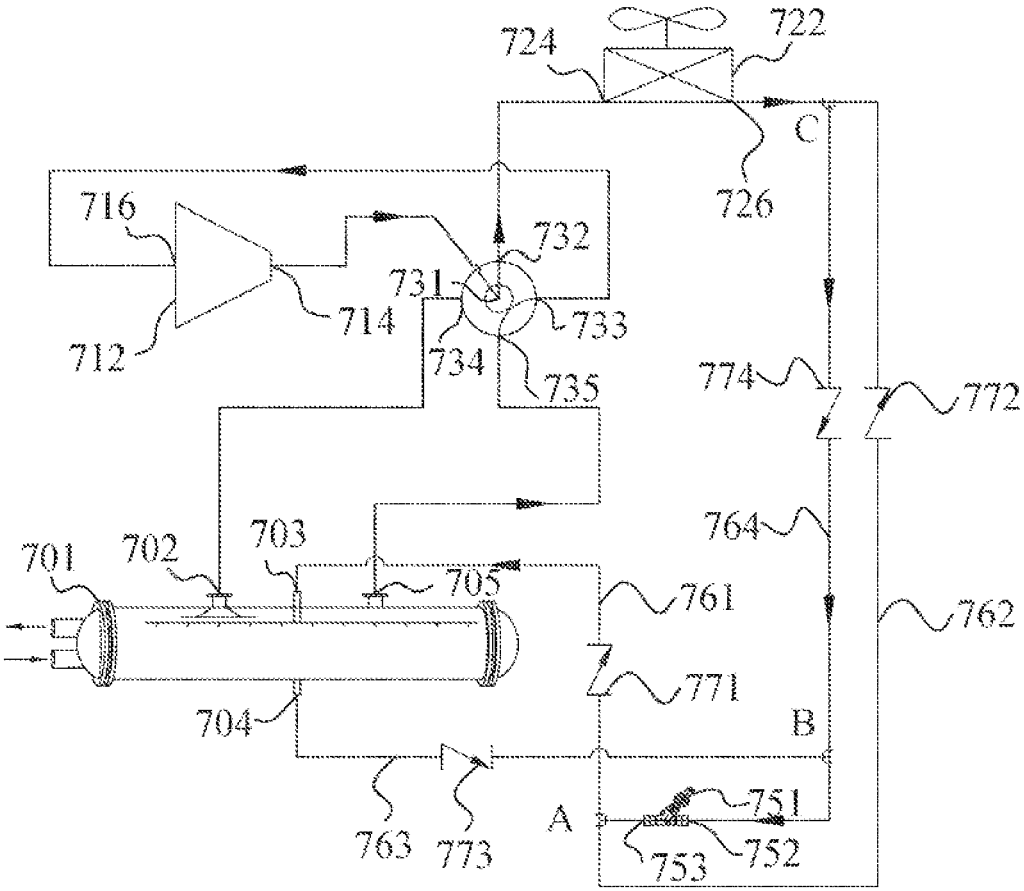
FIG. 13B is a system diagram of the heat pump system shown in FIG. 13A in a refrigeration mode.

FIG. 13B is a system diagram of the heat pump system shown in FIG. 13A in the refrigeration mode. As shown in FIG. 13B, through the control of the control device 801, the five-way valve is in the first state, and the compressor 712, the fan 781 and the throttling device 751 are turned on.

Specifically, the high-temperature and high-pressure gaseous refrigerants flowing out from the exhaust port 714 of the compressor 712 pass through the first connecting port of the valve device 731 and the second connecting port of the valve device 732 in sequence to flow to the second heat exchanger 722. In the second heat exchanger 722, the high-temperature and high-pressure gaseous refrigerants exchange heat with the air, thereby changing the high-temperature and high-pressure gaseous refrigerants into high-pressure liquid refrigerants. The high-pressure liquid refrigerants flow out of the second heat exchanger 722 and then pass through the intersection point C, the one-way valve 774, the intersection point B, and the throttling device 751 in sequence. The high-pressure liquid refrigerants become low-temperature and low-pressure refrigerants after flowing through the throttling device 751, then pass through the one-way valve 771 and enter the first heat exchanger 701 from the second port of the first heat exchanger 703. In the first heat exchanger 701, the low-temperature and low-pressure refrigerants exchange heat with the refrigerants at a relatively high temperature on a user side, thereby reducing the temperature of the refrigerants on the user side to provide the refrigerants at a relatively low temperature for the user side (for example, for providing air-conditioning cold water). The low-temperature and low-pressure refrigerants exchange heat with the refrigerants on the user side in the first heat exchanger 701 and then become low-pressure gaseous refrigerants. After the low-pressure gaseous refrigerants flow out of the first heat exchanger 701 from the fourth port of the first heat exchanger 705, the low-pressure gaseous refrigerants pass through the fifth connecting port of the valve device 735 and the third connecting port of the valve device 733 in sequence, and then enter the compressor 712 from the air suction port 716 of the compressor 712 again to become high-temperature and high-pressure gaseous refrigerants to complete the cycle of the refrigerants.

Figure 13C:
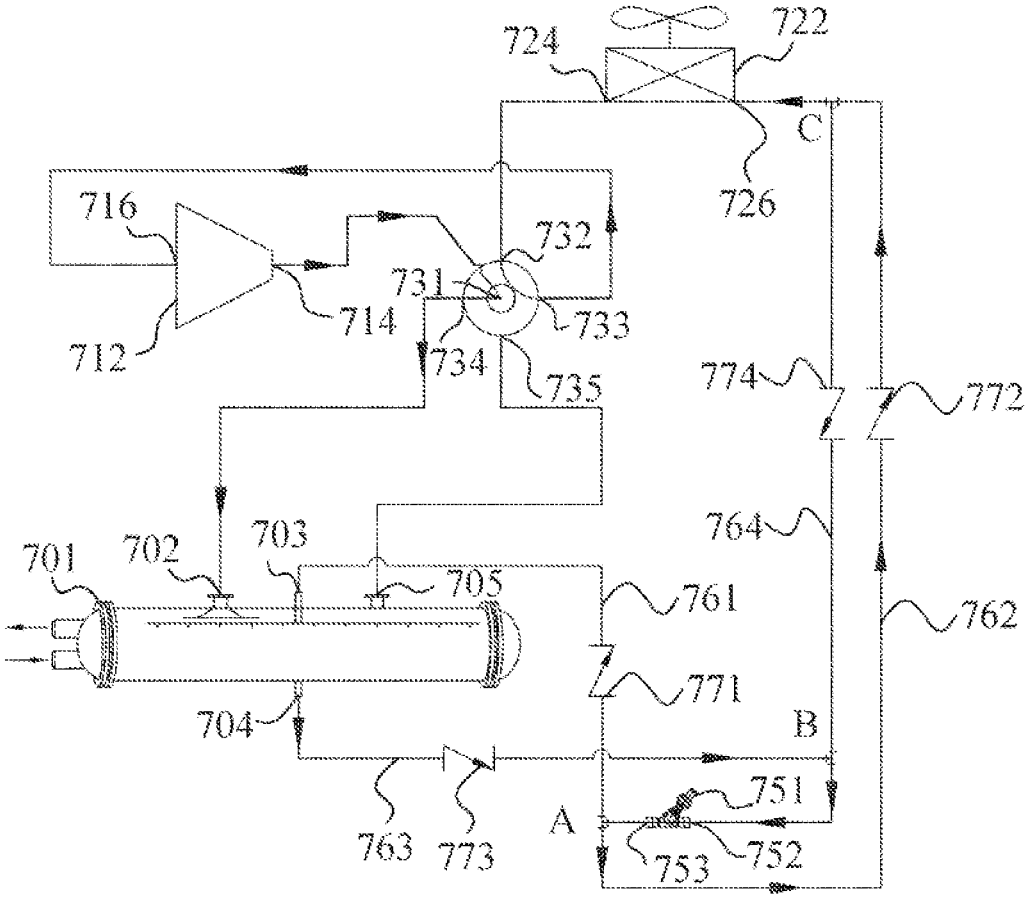
FIG. 13C is a system diagram of the heat pump system shown in FIG. 13A in a heating mode.

FIG. 13C is a system diagram of the heat pump system shown in FIG. 13A in the heating mode. As shown in FIG. 13C, through the control of the control device 801, the five-way valve is in the second state, and the compressor 712, the fan 781 and the throttling device 751 are turned on.

Specifically, the high-temperature and high-pressure gaseous refrigerants flowing out from the exhaust port 714 of the compressor 712 pass through the first connecting port of the valve device 731 and the fourth connecting port of the valve device 734 in sequence, and then flow into the first heat exchanger 701 from the first port of the first heat exchanger 702. In the first heat exchanger 701, the high-temperature and high-pressure gaseous refrigerants exchange heat with the refrigerants at a relatively low temperature on the user side, thereby increasing the temperature of the refrigerants on the user side to provide the refrigerants at a relatively high temperature for the user (for example, for providing air-conditioning hot water). The high-temperature and high-pressure gaseous refrigerants exchange heat with the refrigerants on the user side in the first heat exchanger 701 and then become high-pressure liquid refrigerants. The high-pressure liquid refrigerants flow out of the third port of the first heat exchanger 704 and then pass through the one-way valve 773, the intersection point B and the throttling device 751 in sequence. The high-pressure liquid refrigerants become low-temperature and low-pressure refrigerants after flowing through the throttling device 751, and then pass through the intersection point A, the one-way valve 772 and the intersection point C in sequence to flow to the second heat exchanger 722. In the second heat exchanger 722, the low-temperature and low-pressure refrigerants exchange heat with the air, thereby changing the low-temperature and low-pressure refrigerants into low-pressure gaseous refrigerants. The low-pressure gaseous refrigerants pass through the second connecting port of the valve device 732 and the third connecting port of the valve device 733 in sequence, and then enter the compressor 712 again from the air suction port 716 of the compressor 712 to become high-temperature and high-pressure gaseous refrigerants to complete the cycle of the refrigerants.

Figure 13D:
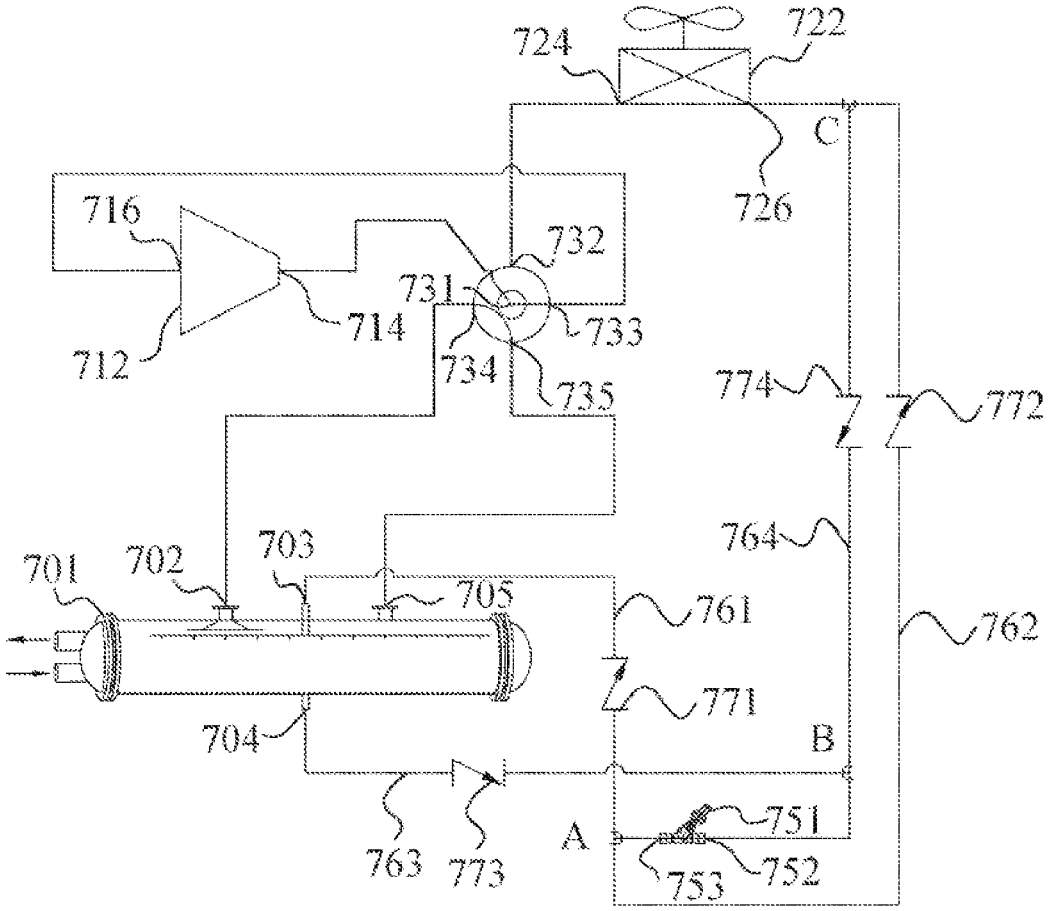
FIG. 13D is a system diagram of the heat pump system shown in FIG. 13A in an isolation mode.

FIG. 13D is a system diagram of the heat pump system shown in FIG. 13A in the isolation mode. As shown in FIG. 13D, through the control of the control device 801, the five-way valve is in the third state, and the compressor 712, the fan 781 and the throttling device 751 are turned off.

Specifically, when the compressor 712 is turned off, the heat pump system is in a shutdown state. At this time, since the five-way valve is in the third state, the first port of the second heat exchanger 724 of the second heat exchanger 722 is disconnected through the five-way valve, and the second port of the second heat exchanger 726 of the second heat exchanger 722 is disconnected from the first heat exchanger 701 through the throttling device 751 in a turned-off state. The first port of the first heat exchanger 702 and the fourth port of the first heat exchanger 705 are connected together through the fourth connecting port of the valve device 734 and the fifth connecting port of the valve device 735 of the five-way valve, and the third port of the first heat exchanger 704 is disconnected from the second heat exchanger 722 through the throttling device 751 in the turned-off state. The exhaust port 714 and the air suction port 716 of the compressor 712 are connected together through the first connecting port of the valve device 731 and the third connecting port of the valve device 733 of the five-way valve. Therefore, the first heat exchanger 701, the second heat exchanger 722 and the compressor 712 are disconnected from each other to prevent the refrigerants from migrating among the first heat exchanger 701, the second heat exchanger 722 and the compressor 712.

Figure 14A:
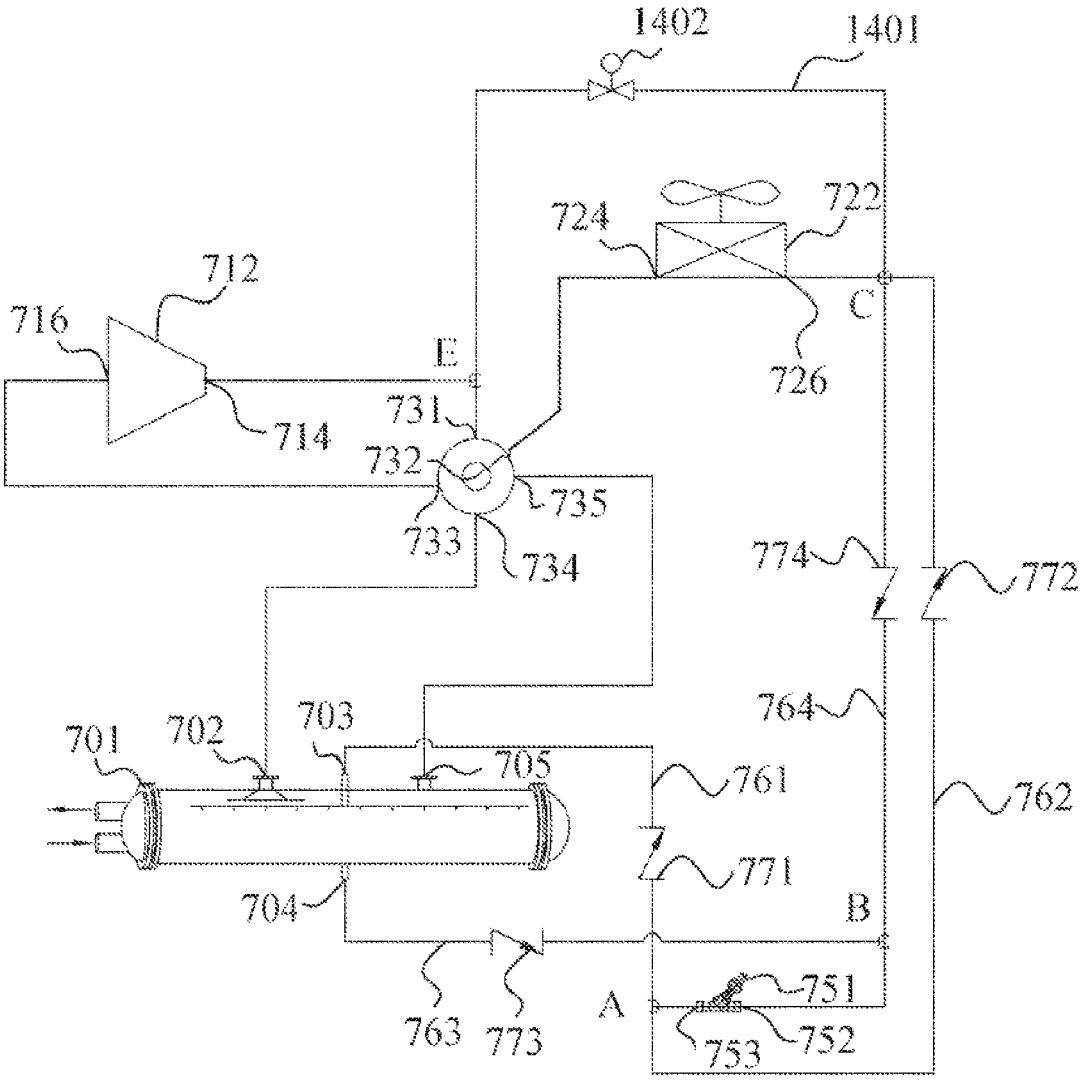
FIG. 14A is a system diagram of a heat pump system using a valve assembly of a fifth embodiment.

FIG. 14A is a system diagram of a heat pump system using a valve device of a fifth embodiment. In the system diagram shown in FIG. 14A, the valve device comprises a five-way valve. The five-way valve comprises five ports, which form a first connecting port of the valve device 731, a second connecting port of the valve device 732, a third connecting port of the valve device 733, a fourth connecting port of the valve device 734, and a fifth connecting port of the valve device 735, respectively. The five-way valve comprises a first circulation channel of the five-way valve and a second circulation channel of the five-way valve, and has a first state, a second state and a third state. When the five-way valve is in the first state, the first connecting port of the valve device 731 is in refrigerant communication with the second connecting port of the valve device 732, and the third connecting port of the valve device 733 is in refrigerant communication with the fifth connecting port of the valve device 735. When the five-way valve is in the second state, the first connecting port of the valve device 731 is in refrigerant communication with the fourth connecting port of the valve device 734, and the second connecting port of the valve device 732 is in refrigerant communication with the third connecting port of the valve device 733. When the five-way valve is in the third state, the second connecting port of the valve device 732 is in refrigerant communication with the fourth connecting port of the valve device 734, and the third connecting port of the valve device 733 is in refrigerant communication with the fifth connecting port of the valve device 735.

The heat pump system shown in FIG. 14A is approximately the same as the heat pump system shown in FIG. 13A, which will not be described again here. The difference is that the heat pump system shown in FIG. 14A further comprises a communication pipe 1401, and the communication pipe 1401 is configured to controllably communicate the exhaust port 714 of the compressor 712 with the second port of the second heat exchanger 726. Specifically, one end of the communication pipe 1401 is connected to an intersection point E of the connecting pipelines between the exhaust port 714 of the compressor 712 and the first connecting port of the valve device 731, and the other end of the communication pipe 1401 is connected to the intersection point C. In addition, the communication pipe 1401 is also provided with a one-way solenoid valve 1402, which is communicatively connected with the control device 801. The one-way solenoid valve 1402 can enable the refrigerants to flow from the intersection point E to the intersection point C in one direction.

Figure 14B:
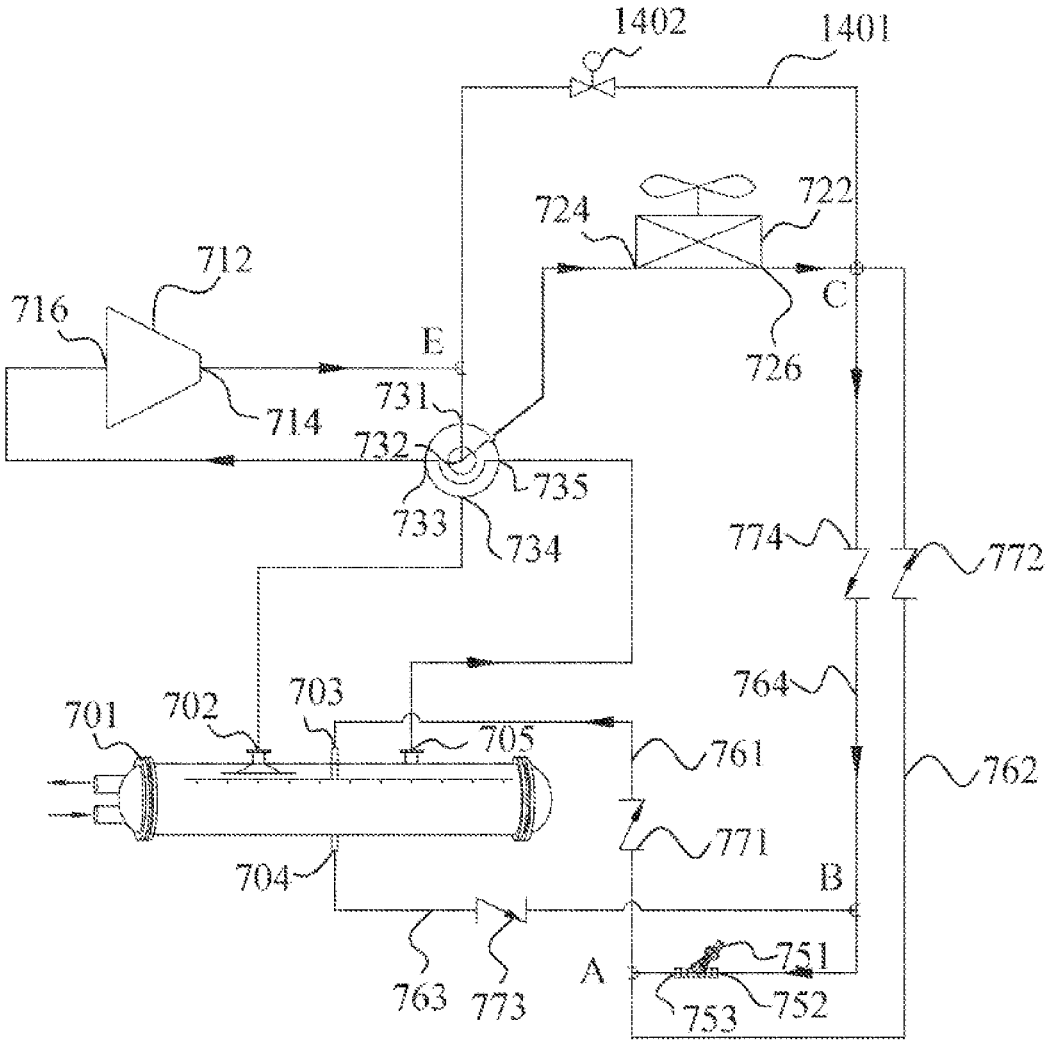
FIG. 14B is a system diagram of the heat pump system shown in FIG. 14A in a refrigeration mode.

FIG. 14B is a system diagram of the heat pump system shown in FIG. 14A in the refrigeration mode. As shown in FIG. 14B, through the control of the control device 801, the five-way valve is in the first state, the compressor 712, the fan 781 and the throttling device 751 are turned on, and the one-way solenoid valve 1402 is turned off.

Specifically, the high-temperature and high-pressure gaseous refrigerants flowing out from the exhaust port 714 of the compressor 712 pass through the intersection point E, the first connecting port of the valve device 731 and the second connecting port of the valve device 732 in sequence to flow to the second heat exchanger 722. In the second heat exchanger 722, the high-temperature and high-pressure gaseous refrigerants exchange heat with the air, thereby changing the high-temperature and high-pressure gaseous refrigerants into high-pressure liquid refrigerants. The high-pressure liquid refrigerants flow out of the second heat exchanger 722 and then pass through the intersection point C, the one-way valve 774, the intersection point B, and the throttling device 751 in sequence. The high-pressure liquid refrigerants become low-temperature and low-pressure refrigerants after flowing through the throttling device 751, then pass through the one-way valve 771 and enter the first heat exchanger 701 from the second port of the first heat exchanger 703. In the first heat exchanger 701, the low-temperature and low-pressure refrigerants exchange heat with the refrigerants at a relatively high temperature on a user side, thereby reducing the temperature of the refrigerants on the user side to provide the refrigerants at a relatively low temperature for the user side (for example, for providing air-conditioning cold water). The low-temperature and low-pressure refrigerants exchange heat with the refrigerants on the user side in the first heat exchanger 701 and then become low-pressure gaseous refrigerants. After the low-pressure gaseous refrigerants flow out of the first heat exchanger 701 from the fourth port of the first heat exchanger 705, the low-pressure gaseous refrigerants pass through the fifth connecting port of the valve device 735 and the third connecting port of the valve device 733 in sequence, and then enter the compressor 712 from the air suction port 716 of the compressor 712 again to become high-temperature and high-pressure gaseous refrigerants to complete the cycle of the refrigerants.

Figure 14C:
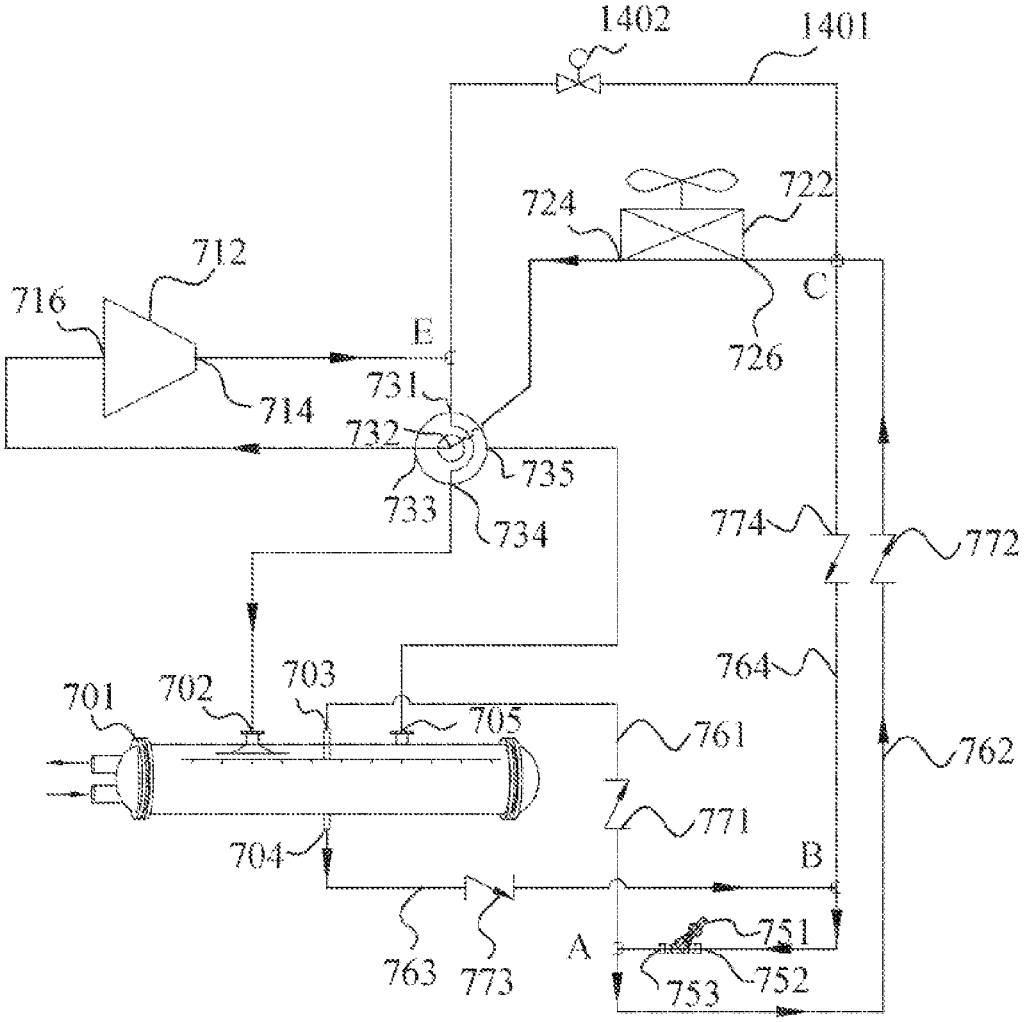
FIG. 14C is a system diagram of the heat pump system shown in FIG. 14A in a heating mode.

FIG. 14C is a system diagram of the heat pump system shown in FIG. 14A in the heating mode. As shown in FIG. 14C, through the control of the control device 801, the five-way valve is in the second state, the compressor 712, the fan 781 and the throttling device 751 are turned on, and the one-way solenoid valve 1402 is turned off.

Specifically, after the high-temperature and high-pressure gaseous refrigerants flowing out from the exhaust port 714 of the compressor 712 pass through the intersection point E, the first connecting port of the valve device 731 and the fourth connecting port of the valve device 734 in sequence, the high-temperature and high-pressure gaseous refrigerants flow into the first heat exchanger 701 from the first port of the first heat exchanger 702. In the first heat exchanger 701, the high-temperature and high-pressure gaseous refrigerants exchange heat with the refrigerants at a relatively low temperature on the user side, thereby increasing the temperature of the refrigerants on the user side to provide the refrigerants at a relatively high temperature for the user (for example, for providing air-conditioning hot water). The high-temperature and high-pressure gaseous refrigerants exchange heat with the refrigerants on the user side in the first heat exchanger 701 and then become high-pressure liquid refrigerants. The high-pressure liquid refrigerants flow out of the third port of the first heat exchanger 704 and then pass through the one-way valve 773, the intersection point B and the throttling device 751 in sequence. The high-pressure liquid refrigerants become low-temperature and low-pressure refrigerants after flowing through the throttling device 751, and then pass through the intersection point A, the one-way valve 772 and the intersection point C in sequence to flow to the second heat exchanger 722. In the second heat exchanger 722, the low-temperature and low-pressure refrigerants exchange heat with the air, thereby changing the low-temperature and low-pressure refrigerants into low-pressure gaseous refrigerants. The low-pressure gaseous refrigerants pass through the second connecting port of the valve device 732 and the third connecting port of the valve device 733 in sequence, and then enter the compressor 712 again from the air suction port 716 of the compressor 712 to become high-temperature and high-pressure gaseous refrigerants to complete the cycle of the refrigerants.

Figure 14D:
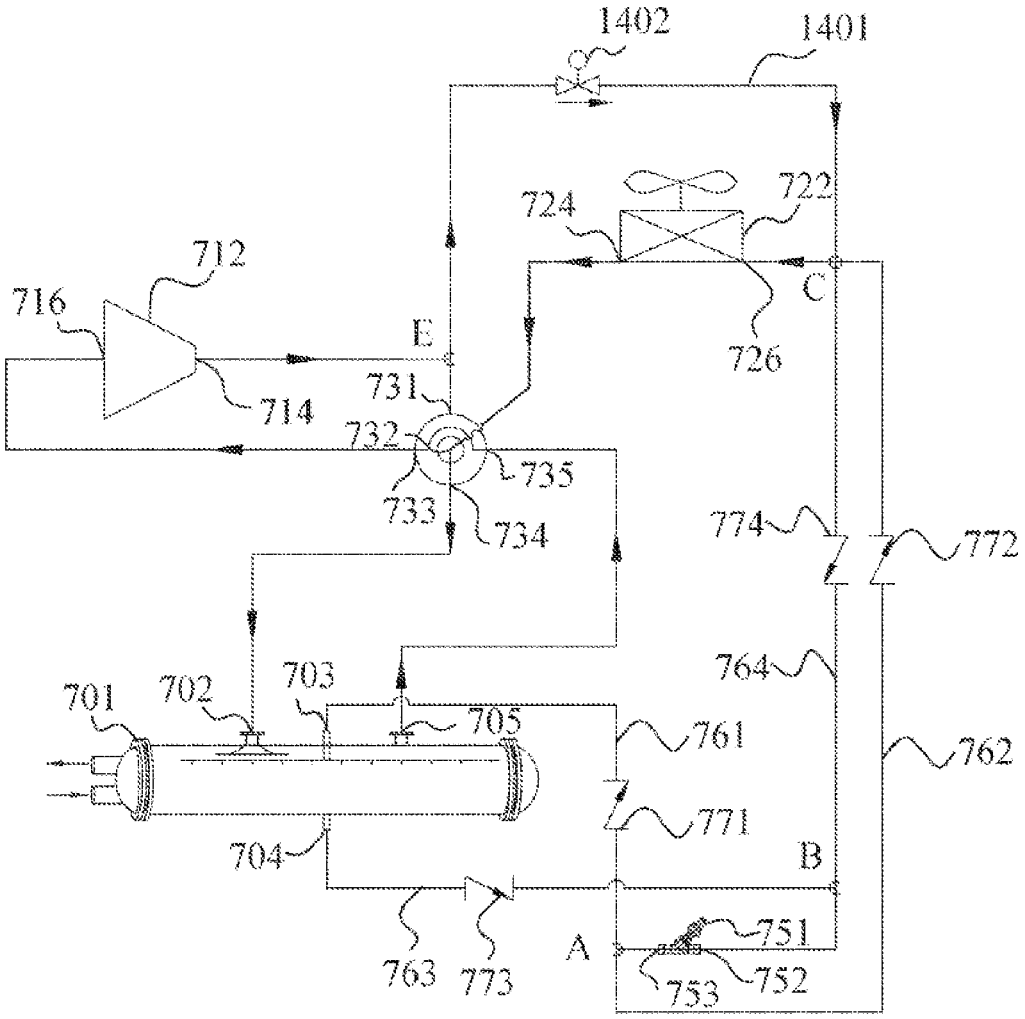
FIG. 14D is a system diagram of the heat pump system shown in FIG. 14A in a liquid drainage mode.

FIG. 14D is a system diagram of the heat pump system shown in FIG. 14A in the liquid drainage mode. As shown in FIG. 14D, through the control of the control device 801, the five-way valve is in the third state, the compressor 712 is turned on, the throttling device 751 and the fan 781 are turned off, and the one-way solenoid valve 1402 is turned on. It should be noted that the liquid drainage mode is a transition mode that the heat pump system is switched from the refrigeration mode to the heating mode. That is to say, when the heat pump system needs to be switched from the refrigeration mode to the heating mode, the heat pump system will first be switched to be in the liquid drainage mode and then be switched to be in the heating mode.

Specifically, the refrigerants flowing out from the exhaust port 714 of the compressor 712 pass through the intersection point E, the one-way solenoid valve 1402, the intersection point C, the second heat exchanger 722, the second connecting port of the valve device 732, and the fourth connecting port of the valve device 734 in sequence, then flow into the first heat exchanger 701 from the first port of the first heat exchanger 702, and then flow out of the first heat exchanger 701 from the fourth port of the first heat exchanger 705. Finally, the refrigerants pass through the fifth connecting port of the valve device 735 and the third connecting port of the valve device 733 in sequence, and then enter the compressor 712 again from the air suction port 716 of the compressor 712 to complete the cycle of the refrigerants.

Therefore, the liquid drainage mode can realize direct communication between the second heat exchanger 722 and the first heat exchanger 701 without passing through the throttling device 751, thereby rapidly draining liquid refrigerants generated by defrosting (i.e., the refrigeration mode) in the second heat exchanger 722 into the first heat exchanger 701 to prevent the liquid refrigerants from directly entering the compressor 712 when the refrigeration mode is directly switched to the heating mode.

Figure 15A:
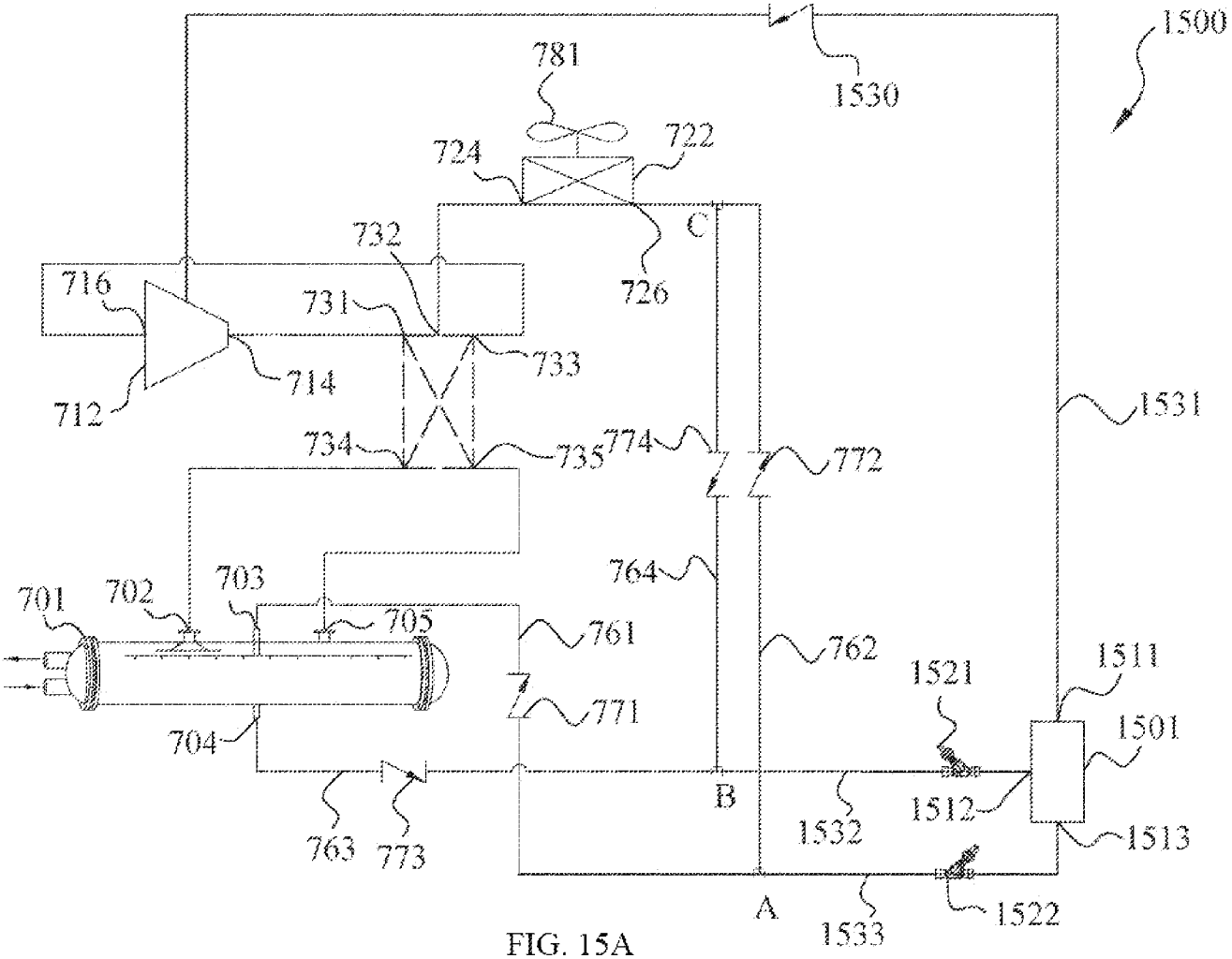
FIG. 15A is a system diagram of another embodiment of the heat pump system of the present application.

FIG. 15A is a system diagram of another embodiment of the heat pump system of the present application. The heat pump system 1500 shown in FIG. 15A is approximately the same as the heat pump system 700 in FIG. 7, which will not be described again here. Compared with the heat pump system 700 of FIG. 7, the heat pump system 1500 shown in FIG. 15A further comprises a flash tank 1501, a first throttling device 1521, a second throttling device 1522, and an additional one-way valve 1530, while the heat pump system 700 of FIG. 7 comprises the throttling device 751. Specifically, the flash tank 1501 comprises a first port of the flash tank 1511, a second port of the flash tank 1512, and a third port of the flash tank 1513. The first port of the flash tank 1511 communicates with an intermediate cavity (not shown) of the compressor 712 through a connecting pipeline 1531, the second port of the flash tank 1512 communicates with the intersection point B through a connecting pipeline 1532, and the third port of the flash tank 1513 communicates with the intersection point A through a connecting pipeline 1533. The connecting pipeline 1531 is provided with the additional one-way valve 1530 for enabling the refrigerants to be able to flow from the first port of the flash tank 1511 to the intermediate cavity of the compressor 712 in one direction. The connecting pipeline 1532 is provided with the first throttling device 1521, and the connecting pipeline 1533 is provided with the second throttling device 1522. The first throttling device 1521 and the second throttling device 1522 are communicatively connected to the control device 801, and the control device 801 is configured to control the on and off of the first throttling device 1521 and the second throttling device 1522.

The heat pump system 1500 can implement multiple operating modes in the heat pump system 1500 through control similar to that in the heat pump system 700, which will not be described again here. The operating principles of the flash tank 1501, the first throttling device 1521 and the second throttling device 1522 are described below:

the refrigerants at the position of the intersection point B are high-pressure liquid refrigerants, and after flowing through the first throttling device 1521, part of the high-pressure liquid refrigerants is throttled into medium-pressure refrigerants, which then enter the flash tank 1501. In the flash tank 1501, the gaseous refrigerants pass through the first port of the flash tank 1511 to enter the intermediate cavity of the compressor 712 through the connecting pipeline, and the liquid refrigerants flow out through the third port of the flash tank 1513 and then flow through the second throttling device 1522, thereby being throttled again to become low-temperature and low-pressure refrigerants to flow to the intersection point A. The arrangement of the flash tank can improve the energy efficiency ratio of the heat pump system.

Figure 15B:
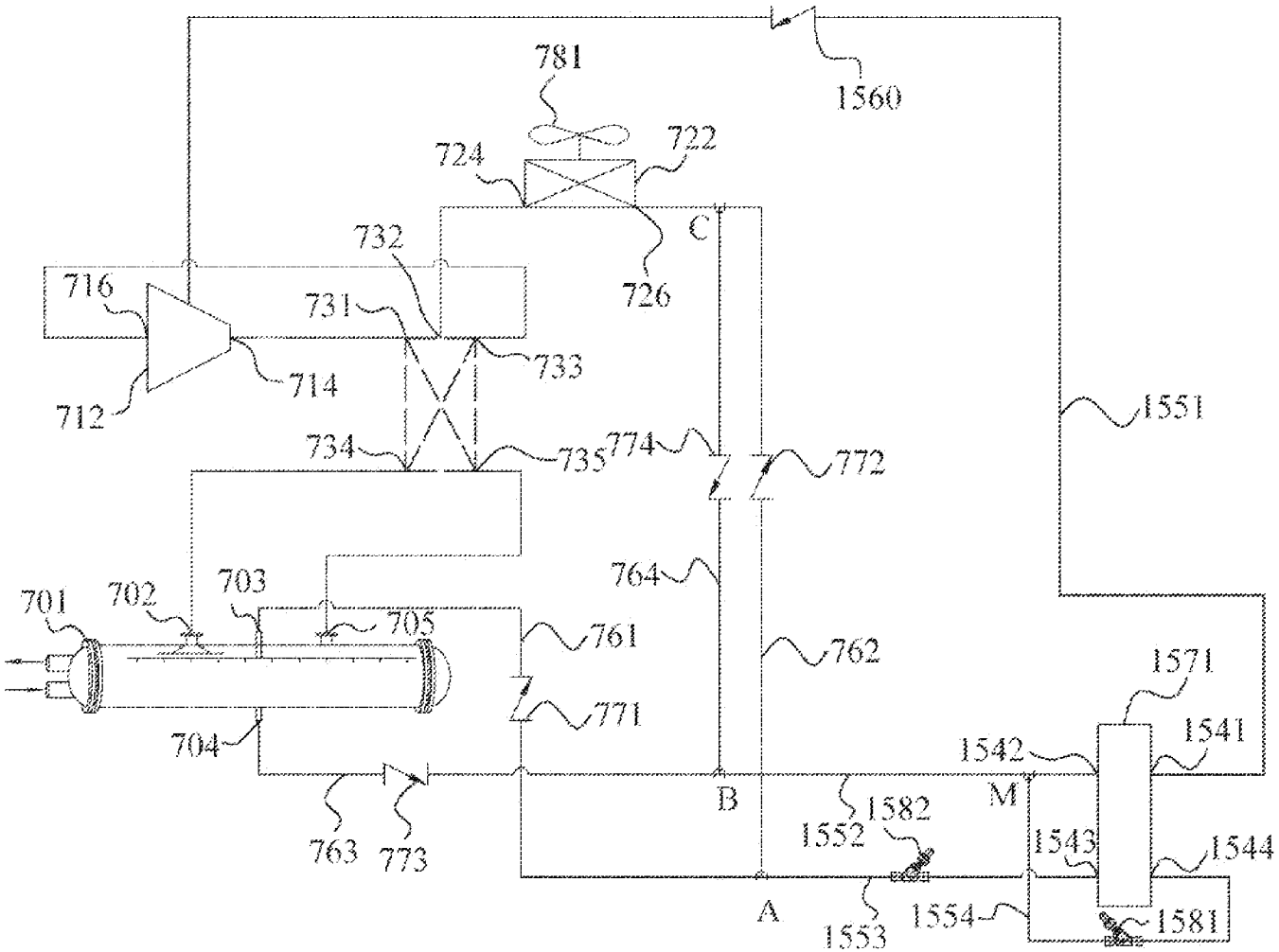
FIG. 15B is a system diagram of still another embodiment of the heat pump system of the present application.

FIG. 15B is a system diagram of still another embodiment of the heat pump system of the present application. The heat pump system shown in FIG. 15B is approximately the same as the heat pump system 700 of FIG. 7, which will not be described again here. Compared with the heat pump system 700 of FIG. 7, the heat pump system shown of FIG. 15B further comprises an additional heat exchanger 1571, a first throttling device 1581, a second throttling device 1582, and an additional one-way valve 1560, while the heat pump system 700 of FIG. 7 comprises the throttling device 751. Specifically, the additional heat exchanger 1571 comprises a first port of the additional heat exchanger 1541, a second port of the additional heat exchanger 1542, a third port of the additional heat exchanger 1543, and a fourth port of the additional heat exchanger 1544. The first port of the additional heat exchanger 1541 communicates with the intermediate cavity (not shown) of the compressor 712 through a connecting pipeline 1551, the second port of the additional heat exchanger 1542 communicates with the intersection point B through a connecting pipeline 1552, the third port of the additional heat exchanger 1543 communicates with the intersection point A through a connecting pipeline 1553, and the fourth port of the additional heat exchanger 1544 communicates with an intersection point M between the intersection point B and the second port of the additional heat exchanger 1542 through a connecting pipeline 1554. The connecting pipeline 1551 is provided with the additional one-way valve 1560 for enabling the refrigerants to be able to flow from the first port of the additional heat exchanger 1541 to the intermediate cavity of the compressor 712 in one direction. The connecting pipeline 1554 is provided with the first throttling device 1581, and the connecting pipeline 1553 is provided with the second throttling device 1582. The first throttling device 1581 and the second throttling device 1582 are communicatively connected to the control device 801, and the control device 801 is configured to control the on and off of the first throttling device 1581 and the second throttling device 1582.

It should be noted that in the additional heat exchanger 1571, the second port of the additional heat exchanger 1542 is in fluid communication with the third port of the additional heat exchanger 1543, and a first flow path is formed in the additional heat exchanger 1571; and the first port of the additional heat exchanger 1541 is in fluid communication with the fourth port of the additional heat exchanger 1544, and a second flow path is formed in the additional heat exchanger 1571. The fluid in the first flow path can exchange heat with the fluid in the second flow path.

The heat pump system shown in FIG. 15B can implement multiple operating modes in the heat pump system through control similar to that in the heat pump system 700, which will not be described again here. The operating principles of the additional heat exchanger 1571, the first throttling device 1581 and the second throttling device 1582 are described below:

the refrigerants at the position of the intersection point B are high-pressure liquid refrigerants. After flowing to the intersection point M, the refrigerants are divided into two paths. One path flows through the first throttling device 1581 from the connecting pipeline 1554. The high-pressure liquid refrigerants become low-temperature and low-pressure refrigerants at the position of the first throttling device 1581, and then flow into the additional heat exchanger 1571 from the fourth port of the additional heat exchanger 1544 of the additional heat exchanger 1571. The other path flows into the additional heat exchanger 1571 from the second port of the additional heat exchanger 1542 of the additional heat exchanger 1571. In the additional heat exchanger 1571, the fluid entering the additional heat exchanger 1571 from the second port of the additional heat exchanger 1542 is further cooled by the fluid flowing into the additional heat exchanger 1571 from the fourth port of the additional heat exchanger 1544, then passes through the third port of the additional heat exchanger 1543 to flow out, and then flows through the second throttling device 1582. However, the fluid flowing into the additional heat exchanger 1571 from the fourth port of the additional heat exchanger 1544 is heated, and then passes through the first port of the additional heat exchanger 1541 to flow to the intermediate cavity (not shown) of the compressor 712.

In the heat pump system shown in FIG. 15B, the additional heat exchanger 1571 and the first throttling device 1581 form an economizer, which on one hand can enable the temperature of the refrigerants flowing through the second throttling device 1582 to be lower, and on the other hand can reduce the exhaust temperature of the compressor 712, thereby improving the efficiency of the heat pump system 700.

Figure 16:
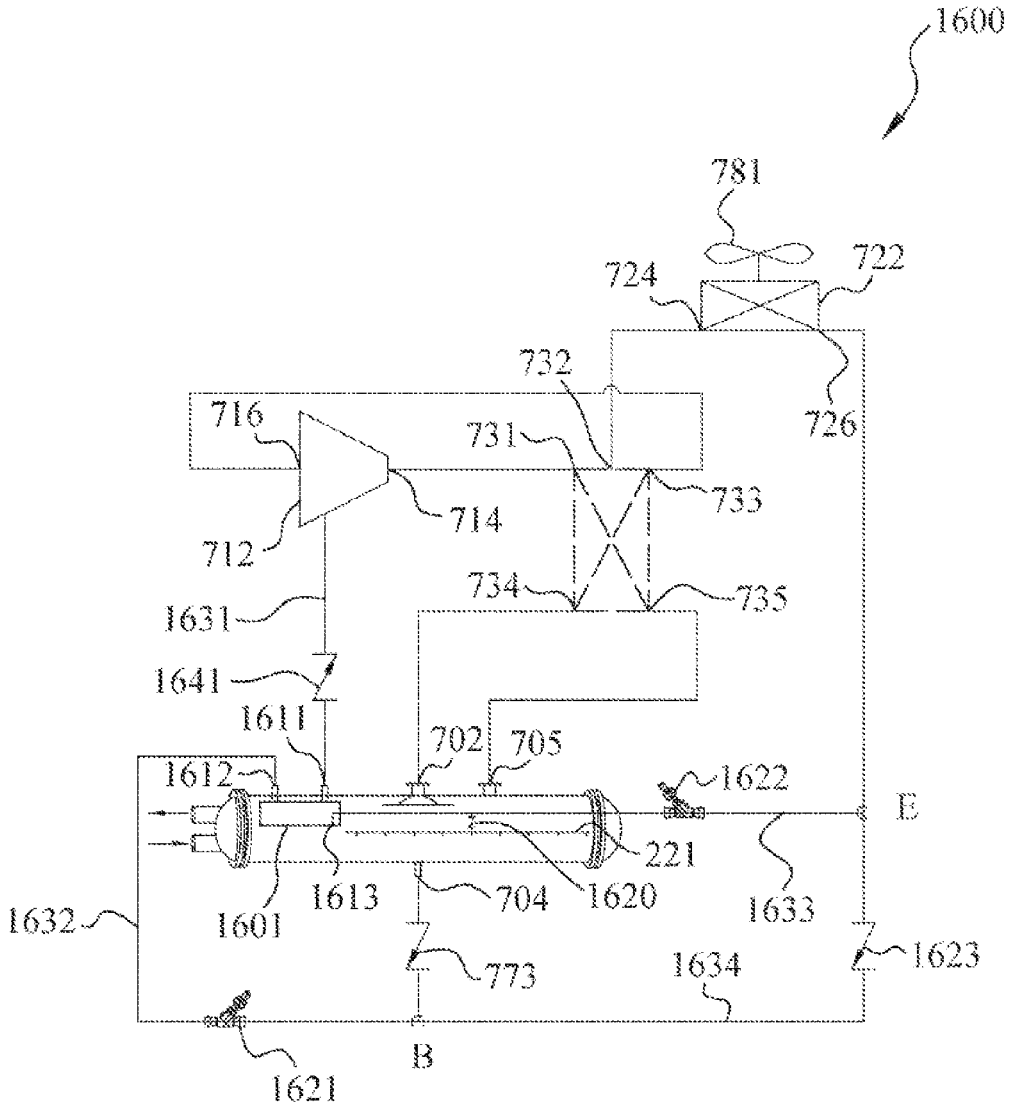
FIG. 16 is a system diagram of yet another embodiment of the heat pump system of the present application.

FIG. 16 is a system diagram of yet another embodiment of the heat pump system of the present application. It should be noted that the first heat exchanger 701 in FIG. 16 is slightly different from the heat exchanger 100 described in FIGS. 1-6B. The similarities will not be described again here. The difference is that the first heat exchanger 701 further comprises a flash tank 1601 and a one-way valve 1620. Specifically, the flash tank 1601 is disposed in the housing 102 as shown in FIG. 1. The flash tank 1601 comprises a first port of the flash tank 1611, a second port of the flash tank 1612, and a third port of the flash tank 1613. The first port of the flash tank 1611 protrudes outward from the housing 102 to communicate with the intermediate cavity (not shown) of the compressor 712 through a connecting pipeline 1631. The connecting pipeline 1631 is provided with the additional one-way valve 1641 for enabling the refrigerants to be able to flow from the first port of the flash tank 1611 to the intermediate cavity of the compressor 712 in one direction. The second port of the flash tank 1612 extends outward from the housing 102 to communicate with the intersection point B through a connecting pipeline 1632. The intersection point B communicates with the second port of the second heat exchanger 726 through a pipeline 1634. The connecting pipeline 1632 is provided with a first throttling device 1621. The third port of the flash tank 1613 is disposed in the housing 102, extends outward from the housing 102 through a connecting pipeline 1633 and is connected to the intersection point E together with the connecting pipeline 1633. The connecting pipeline 1633 is provided with a second throttling device 1622. An internal connecting pipeline is also disposed in the first heat exchanger 701. One end of the internal connecting pipeline is connected onto the connecting pipeline 1633, and the other end of the internal connecting pipeline is connected onto the distributor 221, so that the refrigerants flowing out from the third port of the flash tank 1613 can flow into the distributor 221 through the internal connecting pipeline. The internal connecting pipeline is provided with the one-way valve 1620 to enable the refrigerants to be able to flow from the third port of the flash tank 1613 to the distributor 221 in one direction. The connecting pipeline 1634 is also provided with a one-way valve 1623, which is disposed between the intersection point B and the intersection point E, so that the refrigerants can flow from the intersection point E to the intersection point B in one direction.

Since the heat pump system 1600 shown in FIG. 16 can implement basically the same operating mode as the heat pump system 700 shown in FIG. 7, it will not be described again here. When the flash tank is disposed inside the first heat exchanger 701, the arrangement of pipelines can be reduced, so that the structure inside the first heat exchanger 701 is more compact.

In a traditional heat pump system using a falling film heat exchanger, due to the need to implement different operating modes, it is necessary to dispose valves such as a one-way valve and an on-off valve between an exhaust port of a compressor and a condenser and between an air suction port of the compressor and an evaporator, thereby causing a large pressure drop in a system.

However, the heat pump system of the present application can reduce the pressure drop of the system, especially the pressure drop from the exhaust port 714 of the compressor 712 to the inlet of the first heat exchanger 701 and the pressure drop from the outlet of the first heat exchanger 701 to the air suction port 716 of the compressor 712 are reduced. Specifically, in the present application, by disposing the valve device provided with the first connecting port of the valve device, the second connecting port of the valve device, the third connecting port of the valve device, the fourth connecting port of the valve device and the fifth connecting port of the valve device, the pipeline between the exhaust port 714 of the compressor 712 and the inlet of the first heat exchanger 701 and the pipeline between the outlet of the first heat exchanger 701 and the air suction port 716 of the compressor 712 are not provided with the on-off valve and the one-way valve. In this way, although the refrigerants passing through the pipeline between the exhaust port 714 of the compressor 712 and the inlet of the first heat exchanger 701 and the pipeline between the outlet of the first heat exchanger 701 and the air suction port 716 of the compressor 712 are in a gaseous state, compared to the on-off valve and the one-way valve, the valve device causes a smaller pressure drop on the gaseous refrigerants.

It should be noted that the valve device described in the present application is a valve group for switching the operating mode between the compressor 712 and the first heat exchanger 701, which comprises the three-way valve, the four-way valve, the five-way valve and other reversing valves, but does not comprise the on-off valve and the one-way valve.

It should also be noted that in the present application, in the four embodiments of the heat pump system shown in FIGS. 11A-14D, the schematic diagram of the five-way valve takes a rotary five-way valve as an example. Specifically, the five-way valve comprises a housing and a valve body disposed therein. The housing is provided with a first connecting port of the valve device 731, a second connecting port of the valve device 732, a third connecting port of the valve device 733, a fourth connecting port of the valve device 734, and a fifth connecting port of the valve device 735. The valve body is provided with a first circulation channel of the five-way valve and a second circulation channel of the five-way valve. In the four five-way valves shown in FIGS. 11A-14D, the housing of the five-way valve is a cylinder. The valve body implements communication relationships between different connecting ports by rotating relative to the housing. For example, in the five-way valve shown in FIGS. 11A-11C, the five connecting ports are all disposed in a circumferential direction of the cylinder. In the five-way valve shown in FIGS. 12A-12E, one connecting port (i.e., the third connecting port of the valve device 733) is disposed at the end of the cylinder, and the other four connecting ports are disposed in the circumferential direction of the cylinder.

Those skilled in the art can understand that although the rotary five-way valve is taken as an example in the present application, five-way valves in any arrangement form (for example, a translational five-way valve) are within the scope of protection of the present application.

Although only some of the features of the present application have been illustrated and described herein, various modifications and changes will occur to those skilled in the art. It is therefore to be understood that the appended claims are intended to cover all such modifications and changes that fall within the true spirit of the present application.

The invention claimed is:

1. A heat pump system, the heat pump system having a refrigeration mode and a heating mode, wherein the heat pump system comprises:

a compressor, the compressor comprising an air suction port and an exhaust port;

a first heat exchanger, the first heat exchanger being configured to be able to act as a falling film evaporator or a condenser, the first heat exchanger comprising a first port of the first heat exchanger, a second port of the first heat exchanger, a third port of the first heat exchanger, and a fourth port of the first heat exchanger;

a second heat exchanger, the second heat exchanger comprising a first port of the second heat exchanger and a second port of the second heat exchanger; and a valve device, the valve device comprising a first connecting port of the valve device, a second connecting port of the valve device, a third connecting port of the valve device, a fourth connecting port of the valve device, and a fifth connecting port of the valve device;

wherein the first connecting port of the valve device is connected to the exhaust port of the compressor through a first pipeline, the second connecting port of the valve device is connected to the first port of the second heat exchanger through a second pipeline, the third connecting port of the valve device is connected to the air suction port of the compressor through a third pipeline, the fourth connecting port of the valve device is connected to the first port of the first heat exchanger through a fourth pipeline, and the fifth connecting port of the valve device is connected to the fourth port of the first heat exchanger through a fifth pipeline; and the valve device is configured to:

when the heat pump system is operating in the refrigeration mode, the valve device communicates the third connecting port of the valve device with the air suction port of the compressor, so that the first heat exchanger acts as the falling film evaporator; and when the heat pump system is operating in the heating mode, the valve device communicates the first connecting port of the valve device with the exhaust port of the compressor, so that the first heat exchanger acts as the condenser.

2. The heat pump system according to claim 1, wherein:

the valve device comprises at least one valve, and each of the at least one valve is a reversing valve.

3. The heat pump system according to claim 1, wherein:

the valve device does not comprise an on-off valve and a one-way valve.

4. The heat pump system according to claim 1, wherein:

the valve device comprises a four-way valve and a three-way valve;

wherein the four-way valve comprises four ports, three of the four ports form the first connecting port of the valve device, the second connecting port of the valve device, and the third connecting port of the valve device, respectively, the three-way valve comprises three ports, two of the three ports form the fourth connecting port of the valve device and the fifth connecting port of the valve device, respectively, and a fourth port of the four-way valve is connected to a third port of the three-way valve;

wherein the four-way valve comprises a first pair of circulation channels of the four-way valve and a second pair of circulation channels of the four-way valve, the first pair of circulation channels of the four-way valve can enable the first connecting port of the valve device to be in fluid communication with the second connecting port of the valve device, and can enable the third connecting port of the valve device to be in fluid communication with the fourth connecting port of the four-way valve, and the second pair of circulation channels of the four-way valve can enable the first connecting port of the valve device to be in fluid communication with the fourth port of the four-way valve, and can enable the second connecting port of the valve device to be in fluid communication with the third connecting port of the valve device; and wherein the three-way valve comprises a first circulation channel of the three-way valve and a second circulation channel of the three-way valve, the third port of the three-way valve can be in fluid communication with the fourth connecting port of the valve device through the first circulation channel of the three-way valve, and the third port of the three-way valve can be in fluid communication with the fifth connecting port of the valve device through the second circulation channel of the three-way valve.

5. The heat pump system according to claim 1, wherein:

the valve device comprises a five-way valve, the five-way valve comprises five ports, the five ports form the first connecting port of the valve device, the second connecting port of the valve device, the third connecting port of the valve device, the fourth connecting port of the valve device, and the fifth connecting port of the valve device, respectively.

6. The heat pump system according to claim 5, wherein:

the five-way valve comprises a first circulation channel of the five-way valve and a second circulation channel of the five-way valve;

the five-way valve has a first state and a second state, and the five-way valve is configured to:

when the five-way valve is in the first state, the first connecting port of the valve device communicates with the second connecting port of the valve device, and the third connecting port of the valve device communicates with the fifth connecting port of the valve device; and when the five-way valve is in the second state, the first connecting port of the valve device communicates with the fourth connecting port of the valve device, and the second connecting port of the valve device communicates with the third connecting port of the valve device.

7. The heat pump system according to claim 6, wherein:

the five-way valve has a third state, and the five-way valve is configured to:

when the five-way valve is in the third state, the first connecting port of the valve device communicates with the third connecting port of the valve device, and the fourth connecting port of the valve device communicates with the fifth connecting port of the valve device.

8. The heat pump system according to claim 6, wherein:

the heat pump system further comprises a communication pipe, the communication pipe is configured to controllably communicate the exhaust port of the compressor with the second port of the second heat exchanger; and the five-way valve has a fourth state, and the five-way valve is configured to:

when the five-way valve is in the fourth state, the third connecting port of the valve device communicates with the fourth connecting port of the valve device, and the second connecting port of the valve device communicates with the fifth connecting port of the valve device.

9. The heat pump system according to claim 1, wherein:

a flash tank is disposed in the first heat exchanger.

10. The heat pump system according to claim 1, wherein:

the heat pump system comprises a flash tank or an economizer.

* * * * *